US009662764B2

(12) United States Patent
Fukushima et al.

(10) Patent No.: US 9,662,764 B2
(45) Date of Patent: May 30, 2017

(54) SUBSTRATE HOLDER, POLISHING APPARATUS, AND POLISHING METHOD

(71) Applicant: EBARA CORPORATION, Tokyo (JP)

(72) Inventors: Makoto Fukushima, Tokyo (JP); Hozumi Yasuda, Tokyo (JP); Keisuke Namiki, Tokyo (JP); Osamu Nabeya, Tokyo (JP); Shingo Togashi, Tokyo (JP); Satoru Yamaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 580 days.

(21) Appl. No.: 13/752,659

(22) Filed: Jan. 29, 2013

(65) Prior Publication Data

US 2013/0196573 A1 Aug. 1, 2013

(30) Foreign Application Priority Data

Jan. 31, 2012 (JP) ..... 2012-018538
Mar. 29, 2012 (JP) ..... 2012-076677

(51) Int. Cl.
*B24B 37/04* (2012.01)
*B24B 37/32* (2012.01)
*B24B 37/30* (2012.01)

(52) U.S. Cl.
CPC ..... *B24B 37/32* (2013.01); *B24B 37/04* (2013.01); *B24B 37/042* (2013.01); *B24B 37/30* (2013.01)

(58) Field of Classification Search
CPC ..... B24B 37/04; B24B 37/042; B24B 37/30; B24B 37/32
USPC ..... 451/41, 63, 285, 287, 397, 398
See application file for complete search history.

(56) References Cited

U.S. PATENT DOCUMENTS 4,270,314 A * 6/1981 Cesna ..... B24B 37/102 451/288
5,398,459 A * 3/1995 Okumura ..... B24B 37/30 451/286
6,019,670 A * 2/2000 Cheng ..... B24B 37/32 451/286
6,113,468 A * 9/2000 Natalicio ..... B24B 37/30 451/41
6,709,322 B2 * 3/2004 Saldana ..... B24B 37/32 451/285

(Continued)

FOREIGN PATENT DOCUMENTS

JP 61-025768 A 2/1986
JP 2001-179605 A 7/2001

(Continued)

*Primary Examiner* — Eileen Morgan
(74) *Attorney, Agent, or Firm* — Baker & Hostetler LLP

(57) ABSTRACT

The substrate holder is a device for holding a substrate and pressing it against a polishing pad. The substrate holder includes: an inner retaining ring vertically movable independently of the top ring body and arranged around the substrate; an inner pressing mechanism to press the inner retaining ring against the polishing surface of the polishing pad; an outer retaining ring to vertically movable independently of the inner retaining ring and the top ring body; an outer pressing mechanism to press the outer retaining ring against the polishing surface; and a supporting mechanism to receive a lateral force applied to the inner retaining ring from the substrate during polishing of the substrate and to tiltably support the outer retaining ring.

18 Claims, 29 Drawing Sheets

(56) References Cited

U.S. PATENT DOCUMENTS

| | | | | |
|---|---|---|---|---|
| 7,044,838 | B2 * | 5/2006 | Maloney | B24B 37/30 451/288 |
| 7,311,586 | B2 * | 12/2007 | Maloney | B24B 37/30 451/288 |
| 7,654,888 | B2 | 2/2010 | Zuniga et al. | |
| 7,749,052 | B2 * | 7/2010 | Yi | B24B 37/32 451/288 |
| 7,967,665 | B2 | 6/2011 | Yasuda et al. | |
| 2002/0173242 | A1 * | 11/2002 | Wang | B24B 37/30 451/41 |
| 2006/0128286 | A1 * | 6/2006 | Nabeya | B24B 37/32 451/287 |
| 2010/0273405 | A1 * | 10/2010 | Fukushima | B24B 37/30 451/288 |
| 2013/0102152 | A1 * | 4/2013 | Chao | B24B 37/32 438/692 |
| 2015/0202733 | A1 * | 7/2015 | Yasuda | B24B 37/107 451/286 |

FOREIGN PATENT DOCUMENTS

| | | | |
|---|---|---|---|
| JP | 2004-327547 | A | 11/2004 |
| JP | 2007-268654 | A | 10/2007 |
| JP | 2008-302464 | A | 12/2008 |
| JP | 2008-307674 | A | 12/2008 |
| JP | 2009-190101 | A | 8/2009 |
| JP | 2010-050436 | A | 3/2010 |
| JP | 2011-124302 | A | 6/2011 |

* cited by examiner

SUBSTRATE HOLDER, POLISHING APPARATUS, AND POLISHING METHOD

CROSS REFERENCE TO RELATED APPLICATIONS

This document claims priorities to Japanese Patent Application No. 2012-18538 filed Jan. 31, 2012 and Japanese Patent Application No. 2012-76677 filed Mar. 29, 2012, the entire contents of which are hereby incorporated by reference.

BACKGROUND OF THE INVENTION

Field of the Invention

The present invention relates to a substrate holder for use in a polishing apparatus for polishing a substrate, such as a wafer, and more particularly to a substrate holder for holding a substrate and pressing the substrate against a polishing surface. The present invention further relates to a polishing apparatus and a polishing method using such a substrate holder.

Description of the Related Art

With a recent trend toward higher integration and higher density in semiconductor devices, circuit interconnects become finer and finer and the number of levels in multilayer interconnect is increasing. In the fabrication process of the multilayer interconnect with finer circuit, as the number of interconnect levels increases, film coverage (or step coverage) of step geometry is lowered in thin film formation because surface steps grow while following surface irregularities on a lower layer. Therefore, in order to fabricate the multilayer interconnect, it is necessary to improve the step coverage and planarize the surface. It is also necessary to planarize semiconductor device surfaces so that irregularity steps formed thereon fall within a depth of focus in optical lithography. This is because finer optical lithography entails shallower depth of focus.

Accordingly, the planarization of the semiconductor device surfaces is becoming more important in the fabrication process of the semiconductor devices. Chemical mechanical polishing (CMP) is the most important technique in the surface planarization. This chemical mechanical polishing is a process of polishing a wafer with use of a polishing apparatus by placing the wafer in sliding contact with a polishing surface of a polishing pad while supplying a polishing liquid containing abrasive grains, such as silica ($SiO_2$), onto the polishing surface.

The polishing apparatus of this type has a polishing table that supports the polishing pad, and a substrate holder for holding the wafer. The substrate holder is often called a top ring or a polishing head. This polishing apparatus polishes the wafer as follows. The substrate holder holds the wafer and presses it against the polishing surface of the polishing pad at predetermined pressure. The polishing table and the substrate holder are moved relative to each other to bring the wafer into sliding contact with the polishing surface to thereby polish a surface of the wafer to flat and mirror finish.

When polishing the wafer, if a relative pressing force applied between the wafer and the polishing pad is not uniform over the surface of the wafer in its entirety, lack of polishing or excessive polishing would occur depending on the pressing force applied to each portion of the wafer. Thus, in order to even the pressing force exerted on the wafer, the substrate holder has at its lower part a pressure chamber formed by a flexible membrane. This pressure chamber is supplied with fluid, such as air, to press the wafer through the flexible membrane by the fluid pressure.

However, since the above-described polishing pad has elasticity, the pressing force becomes non-uniform in an edge portion (peripheral portion) of the wafer during polishing. Such non-uniform pressing force would result in so-called "rounded edge" which is excessive polishing that occurs only in the edge portion of the wafer. In order to prevent such rounded edge, the substrate holder has a retaining ring for retaining the edge portion of the wafer. This retaining ring is configured to be vertically movable relative to a top ring body (or carrier head body) and press a region in the polishing surface of the polishing pad around the wafer.

There has recently been an increasing demand for controlling a polishing profile in the edge portion and its neighboring portion of the wafer. In order to meet such a demand, there has been proposed a substrate holder having two retaining rings with different diameters disposed around the wafer. For example, Japanese laid-open patent publication No. 2008-302464 discloses a substrate holder having a first retaining ring and a second retaining ring which are configured to be able to control their pressing forces independently of each other, so that uniformity of the polishing profile is improved.

The inventors of the present invention have found from results of various experiments that, during polishing, the wafer is pushed against an inner surface of the retaining ring by a frictional force generated between the wafer and the polishing surface and that a downstream portion, with respect to a rotating direction of the polishing pad, of the wafer is polished at a very high polishing rate, compared with a central portion of the wafer. Further, the inventors of the present invention have found the fact that, under such wafer polishing conditions, there are cases where the polishing profile cannot be controlled in the wafer edge portion and as a result a desired polishing profile cannot be obtained even when using the two retaining rings with different diameters.

During polishing, the frictional force is produced between the wafer and the polishing pad. This frictional force acts as a lateral force (or a horizontal force) on the retaining ring. Japanese laid-open patent publication No. 2007-268654 (hereinafter, this publication will be referred to as patent document) discloses a substrate holder designed to support this lateral force by a retaining ring guide arranged around the retaining ring. However, in this substrate holder, a point at which the retaining ring guide supports the retaining ring is located away from the polishing surface. This arrangement causes the retaining ring to tilt around this supporting point when it is receiving the lateral force from the wafer. As a result, the retaining ring cannot apply a desired pressing force to the polishing surface uniformly. In addition, the retaining ring may be deformed in some portions thereof by the lateral force applied from the wafer. Such a deformed portion prevents the retaining ring from exerting the desired pressing force on the polishing surface.

Moreover, the substrate holder disclosed in the above-mentioned patent document has a problem that sliding contact between an outer surface of the retaining ring and an inner surface of the retaining ring guide produces wear particles. If the wear particles fall onto the polishing surface, defect of the wafer could occur. Thus, in order to prevent the wear particles from falling onto the polishing surface, a flexible sheet is provided in the substrate holder. However, if the substrate holder is modified so as to lower the supporting point of the retaining ring (i.e., the contact point between the retaining ring and the retaining ring guide) for the purpose of reducing the tilting movement of the retaining ring, the flexible sheet cannot be installed in the substrate holder. As a result, the wear particles would fall onto the polishing surface.

Japanese laid-open patent publication No. 2009-190191 discloses a substrate holder that does not have the retaining ring guide as disclosed in the above patent document. Instead, a spherical bearing is provided above the center of the wafer so as to support the lateral force applied from the wafer to the retaining ring. This configuration does not produce the wear particles outside of the retaining ring and therefore the wear particles do not fall onto the polishing surface.

However, the above spherical bearing is located away from the polishing surface. This arrangement causes the retaining ring to tilt around this spherical bearing when it is receiving the lateral force from the wafer. As a result, the retaining ring cannot apply a desired pressing force to the polishing surface uniformly. In addition, the retaining ring may be defaulted in some portions thereof by the lateral force applied from the wafer. This leads to a problem that the deformed portion prevents the retaining ring from exerting the desired pressing force on the polishing surface.

SUMMARY OF THE INVENTION

It is therefore a first object of the present invention to provide a substrate holder capable of controlling a polishing profile of an edge portion of a substrate and to provide a polishing apparatus and a polishing method using such a substrate holder.

It is a second object of the present invention to provide a substrate holder capable of preventing foreign particles, such as wear particles, from falling onto a polishing surface and capable of enabling a retaining ring to apply a desired pressing force to the polishing surface uniformly and to provide a polishing apparatus and a polishing method using such a substrate holder.

The first aspect of the present invention for achieving the above first object provides a substrate holder including: a top ring body configured to hold a flexible membrane for pressing a substrate against a polishing surface; an inner retaining ring configured to be vertically movable independently of the top ring body and arranged so as to surround the substrate; an inner pressing mechanism configured to press the inner retaining ring against the polishing surface; an outer retaining ring arranged radially outwardly of the inner retaining ring and configured to vertically movable independently of the inner retaining ring and the top ring body; an outer pressing mechanism configured to press the outer retaining ring against the polishing surface; and a supporting mechanism configured to receive a lateral force applied to the inner retaining ring from the substrate during polishing of the substrate and to tiltably support the outer retaining ring.

In a preferred aspect of the present invention, the supporting mechanism is a spherical bearing.

In a preferred aspect of the present invention, the inner pressing mechanism and the outer pressing mechanism are configured to be able to press the inner retaining ring and the outer retaining ring against the polishing surface independently of each other.

In a preferred aspect of the present invention, a center of tilting movement of the outer retaining ring lies on a central axis of the outer retaining ring.

In a preferred aspect of the present invention, the outer retaining ring is vertically movably supported by the supporting mechanism.

The second aspect of the present invention provides a substrate holder including: a top ring body configured to hold a flexible membrane for pressing a substrate against a polishing surface; an inner retaining ring configured to be vertically movable independently of the top ring body and arranged so as to surround the substrate; an inner pressing mechanism configured to press the inner retaining ring against the polishing surface; an outer retaining ring arranged radially outwardly of the inner retaining ring and secured to the top ring body; a load transfer member configured to transfer a downward load to the top ring body; and a spherical bearing configured to allow the top ring body to tilt with respect to the load transfer member.

In a preferred aspect of the present invention, a center of tilting movement of the top ring body lies on a center of a spherical surface of the spherical bearing.

In a preferred aspect of the present invention, the top ring body includes a carrier holding the flexible membrane, and a vertically moving mechanism configured to vertically move the carrier.

Another aspect of the present invention provides a polishing apparatus including: the above-described substrate holder; and a polishing table for supporting a polishing pad having a polishing surface.

The third aspect of the present invention provides a method of polishing a substrate. The method includes: rotating a polishing pad; supplying a polishing liquid onto a polishing surface of the polishing pad; and pressing the substrate against the polishing surface by the above-described substrate holder to polish the substrate.

The fourth aspect of the present invention for achieving the above second object provides a substrate holder including: a top ring body configured to hold a flexible membrane for pressing a substrate against a polishing surface; an inner retaining ring configured to be vertically movable independently of the top ring body and arranged so as to surround the substrate; an inner pressing mechanism configured to press the inner retaining ring against the polishing surface; an outer retaining ring arranged radially outwardly of the inner retaining ring and configured to vertically movable independently of the inner retaining ring and the top ring body; an outer pressing mechanism configured to press the outer retaining ring against the polishing surface; and a supporting mechanism configured to receive a lateral force applied to the inner retaining ring from the substrate during polishing of the substrate and configured not to permit transmission of the lateral force from the inner retaining ring to the outer retaining ring.

In a preferred aspect of the present invention, the supporting mechanism is located in the top ring body.

In a preferred aspect of the present invention, the inner pressing mechanism and the outer pressing mechanism are configured to be able to press the inner retaining ring and the outer retaining ring against the polishing surface independently of each other.

In a preferred aspect of the present invention, the inner retaining ring is tiltably supported by the supporting mechanism.

In a preferred aspect of the present invention, a center of tilting movement of the inner retaining ring lies below the supporting mechanism.

In a preferred aspect of the present invention, a center of tilting movement of the inner retaining ring lies on the polishing surface or near the polishing surface.

In a preferred aspect of the present invention, the inner retaining ring is vertically movably supported by the supporting mechanism.

The fifth aspect of the present invention provides a substrate holder including: a top ring body configured to hold a flexible membrane for pressing a substrate against a polishing surface; a retaining ring arranged so as to surround the substrate and configured to contact the polishing surface; and a spherical bearing configured to tiltably support the retaining ring. A center of tilting movement of the inner retaining ring lies below the spherical bearing.

In a preferred aspect of the present invention, the substrate holder further includes a pressing mechanism configured to press the retaining ring against the polishing surface. The retaining ring is vertically movable independently of the top ring body.

In a preferred aspect of the present invention, the retaining ring is vertically movably supported by the spherical bearing.

In a preferred aspect of the present invention, the spherical bearing includes an intermediate bearing ring in a form of a partial spherical shell coupled to the retaining ring; an outer bearing ring configured to slidably support the intermediate bearing from above; and an inner bearing ring configured to slidably support the intermediate bearing from below. The outer bearing ring, the intermediate bearing ring, and the inner bearing ring have sliding contact surfaces having a partial spherical shape smaller than an upper half of a spherical surface.

In a preferred aspect of the present invention, at least one of the sliding contact surfaces of the outer bearing ring, the intermediate bearing ring, and the inner bearing ring is made of ceramic.

In a preferred aspect of the present invention, a center of tilting movement of the inner retaining ring lies on the polishing surface or near the polishing surface.

In a preferred aspect of the present invention, the retaining ring is an inner retaining ring. The substrate holder further includes an outer retaining ring arranged radially outwardly of the inner retaining ring and configured to contact the polishing surface.

In a preferred aspect of the present invention, the substrate holder further includes an outer pressing mechanism configured to press the outer retaining ring against the polishing surface. The outer retaining ring is vertically movable independently of the inner retaining ring and the top ring body.

The fifth aspect of the present invention provides a substrate holder including: a top ring body configured to hold a flexible membrane for pressing a substrate against a polishing surface; an inner retaining ring arranged so as to surround the substrate and configured to contact the polishing surface; an outer retaining ring arranged radially outwardly of the inner retaining ring and configured to contact the polishing surface; and a barrier seal arranged so as to seal a gap between the inner retaining ring and the outer retaining ring.

In a preferred aspect of the present invention, the substrate holder further includes an inner pressing mechanism configured to press the inner retaining ring against the polishing surface. The inner retaining ring is configured to be vertically movable independently of the top ring body.

In a preferred aspect of the present invention, the substrate holder further includes an outer pressing mechanism configured to press the outer retaining ring against the polishing surface. The outer retaining ring is configured to vertically movable independently of the inner retaining ring and the top ring body.

In a preferred aspect of the present invention, the inner retaining ring and the outer retaining ring are kept out of contact below the barrier seal.

In a preferred aspect of the present invention, the substrate holder further includes a supporting mechanism configured to receive a lateral force applied to the inner retaining ring from the substrate during polishing of the substrate and to tiltably support the outer retaining ring.

In a preferred aspect of the present invention, the substrate holder further includes a supporting mechanism configured to receive a lateral force applied to the inner retaining ring from the substrate during polishing of the substrate and configured not to permit transmission of the lateral force from the inner retaining ring to the outer retaining ring.

In a preferred aspect of the present invention, the supporting mechanism is located in the top ring body.

The seventh aspect of the present invention provides a polishing apparatus including: the above-described substrate holder; and a polishing table for supporting a polishing pad having a polishing surface.

The eight aspect of the present invention provides a method of polishing a substrate. The method includes: rotating a polishing pad; supplying a polishing liquid onto a polishing surface of the polishing pad; and pressing the substrate against the polishing surface by the above-described substrate holder to polish the substrate.

According to the above-described first aspect of the present invention, the frictional force acting on the substrate is transmitted to the outer retaining ring through the inner retaining ring. The outer retaining ring, which receives the frictional force of the substrate indirectly, tilts around the fulcrum of the supporting mechanism during polishing of the substrate. Specifically, the outer retaining ring tilts in a sinking direction at an upstream side of the substrate with respect to a rotating direction of the polishing surface, while the outer retaining ring tilts in a rising direction at a downstream side of the substrate. When the load on the inclined outer retaining ring is changed (e.g., increased), a load on the polishing surface changes most significantly in the region downstream of the substrate. Therefore, by positively allowing the outer retaining ring to tilt around the fulcrum of the supporting mechanism, the polishing profile can be changed in the downstream edge portion which is most likely to be affected by the change in the load because a polishing rate of this portion is originally high. As a result, the polishing profile of the edge portion in its entirety can be controlled by the control of the load on the outer retaining ring. Further, according to the present invention, the outer retaining ring is supported movably in the vertical direction by the supporting mechanism. This configuration can increase wear tolerance of the outer retaining ring and can therefore increase a lifetime of the outer retaining ring.

According to the above-described second aspect of the present invention, the same effects as those of the first aspect can be obtained. That is, the polishing profile in the substrate edge portion can be controlled in its entirety by positively tilting the outer retaining ring, secured to the top ring body, about the spherical bearing so as to change the polishing profile in the downstream-side edge portion.

According to the above-described fourth aspect of the present invention, the outer retaining ring is arranged around the inner retaining ring that receives the lateral force from the substrate. The inner retaining ring and the outer retaining ring are configured to be able to press the polishing surface separately. The lateral force acting on the inner retaining ring is received by the supporting mechanism, so that this lateral force, which is applied from the substrate to the inner retaining ring during polishing of the substrate, does not act on the outer retaining ring. This arrangement can reduce the tilting movement of the outer retaining ring with respect to the polishing surface and can prevent the local deformation of the outer retaining ring. Therefore, the outer retaining ring can apply a desired pressing force to the polishing surface.

According to the above-described fifth aspect of the present invention, the center of the tilting movement of the retaining ring is located below the spherical bearing. Therefore, the center of the tilting movement can be lowered so as to lie on the polishing surface or near the polishing surface. With this arrangement, a moment of force acting on the retaining ring becomes zero or very small. Consequently, a degree of the tilting movement of the retaining ring becomes small and therefore the retaining ring can apply a desired pressing force to the polishing surface uniformly. It is possible to provide an outer retaining ring around the above-described retaining ring which is now an inner retaining ring. Since the outer retaining ring does not receive the lateral force that is produced due to the frictional force acting between the substrate and the polishing surface, the tilting movement and any local deformation of the outer retaining ring do not occur. Therefore, the outer retaining ring can exert a desired pressing force on the polishing surface.

According to the above-described sixth aspect of the present invention, the outer retaining ring is arranged around the inner retaining ring that receives the lateral force from the substrate. In this substrate holder having the inner retaining ring and the outer retaining ring, several sliding parts exist above these two retaining rings, because a torque and a pressing force are transmitted between the two retaining rings through these sliding parts. Wear particles, which could be produced from the sliding parts, may fall onto the polishing surface through a gap between the two retaining rings. Moreover, a polishing liquid (slurry) may enter the substrate holder through the gap, hindering the substrate holder from operating properly. According to the above-described sixth aspect of the present invention, the barrier seal is provided between the inner retaining ring and the outer retaining ring. This barrier seal can prevent the wear particles from falling onto the polishing surface and can also prevent the polishing liquid from entering the substrate holder.

DETAILED DESCRIPTION OF THE PREFERRED EMBODIMENTS

Figure 1:
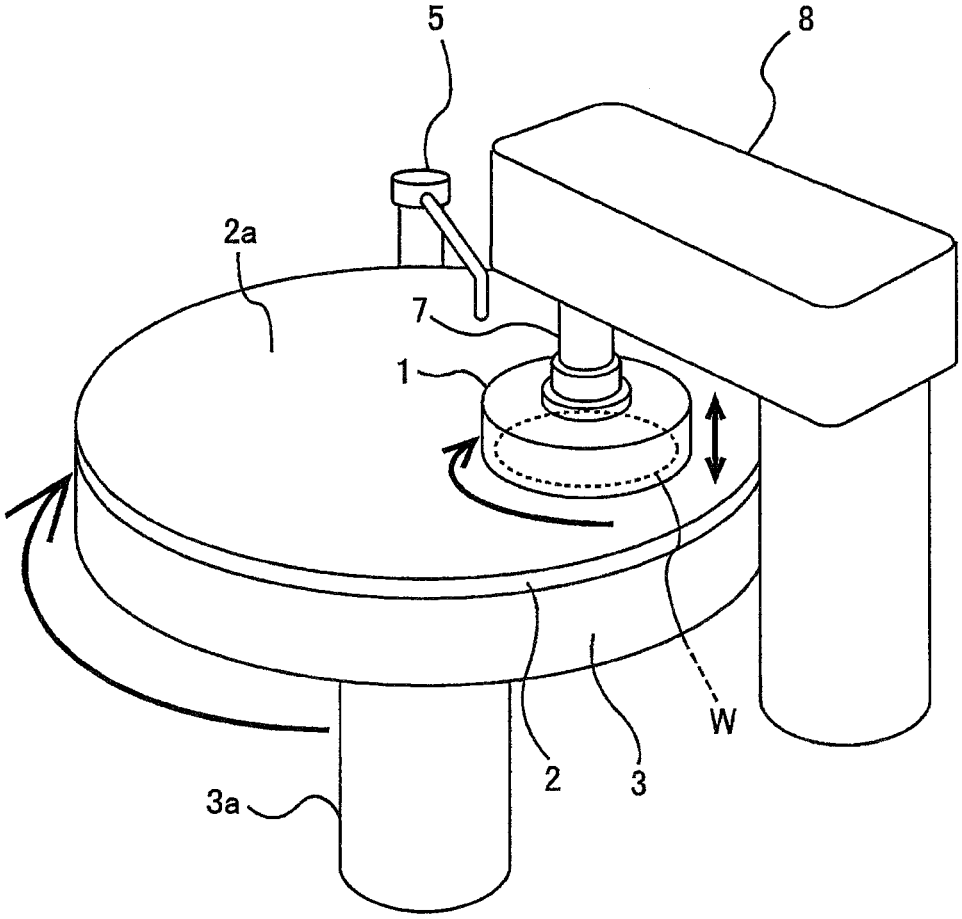
FIG. 1 is a perspective view showing an overall arrangement of a polishing apparatus including a substrate holder (top ring) according to an embodiment of the present invention.

Embodiments of the present invention will be described in detail below with reference to the drawings. Identical or corresponding parts are denoted by identical reference numerals throughout the views and their repetitive explanations will be omitted.

FIG. 1 is a schematic view of an overall arrangement of a polishing apparatus including a substrate holder (top ring) according to an embodiment of the present invention. As shown in FIG. 1, the polishing apparatus has: a polishing table 3 supporting a polishing pad 2 thereon; and a top ring 1 as a substrate holder for holding a wafer W, which is an object to be polished, and pressing the wafer W against the polishing pad 2.

The polishing table 3 is coupled to a motor (not shown) disposed therebelow through a table shaft 3*a*, and is rotated about an axis of the table shaft 3*a* by the motor. The polishing pad 2, which is attached to an upper surface of the polishing table 3, has an upper surface 2*a* serving as a polishing surface for polishing the wafer W. The polishing apparatus further includes a polishing liquid supply mechanism 5 disposed above the polishing table 3. This polishing liquid supply mechanism 5 is configured to supply a polishing liquid onto the polishing pad 2.

The top ring 1 is coupled to a top ring shaft 7 that is vertically moved by a vertically moving mechanism (not shown) disposed in a top ring head 8. When the top ring shaft 7 is moved up and down, the top ring 1 in its entirety is elevated and lowered relative to the top ring head 8 as indicated by vertical arrows, so that positioning of the top ring 1 is performed. The top ring shaft 7 is further coupled to a rotating mechanism (not shown) housed in the top ring head 8, so that the top ring shaft 7 is rotated about its own axis. When the top ring shaft 7 is rotated, the top ring 1 is also rotated about its own axis, as indicated by arrow. The above-described vertically moving mechanism and the rotating mechanism for the top ring 1 may be constructed using known techniques.

The top ring 1 and the polishing table 3 are rotated as indicated by the arrows. In this state, the top ring 1 presses the wafer W against the polishing surface 2*a* of the polishing pad 2, while the polishing liquid supply mechanism 5 supplies the polishing liquid onto the polishing pad 2. The wafer W is polished by sliding contact with the polishing pad 2 in the presence of the polishing liquid between the polishing pad 2 and the wafer W.

Figure 2:
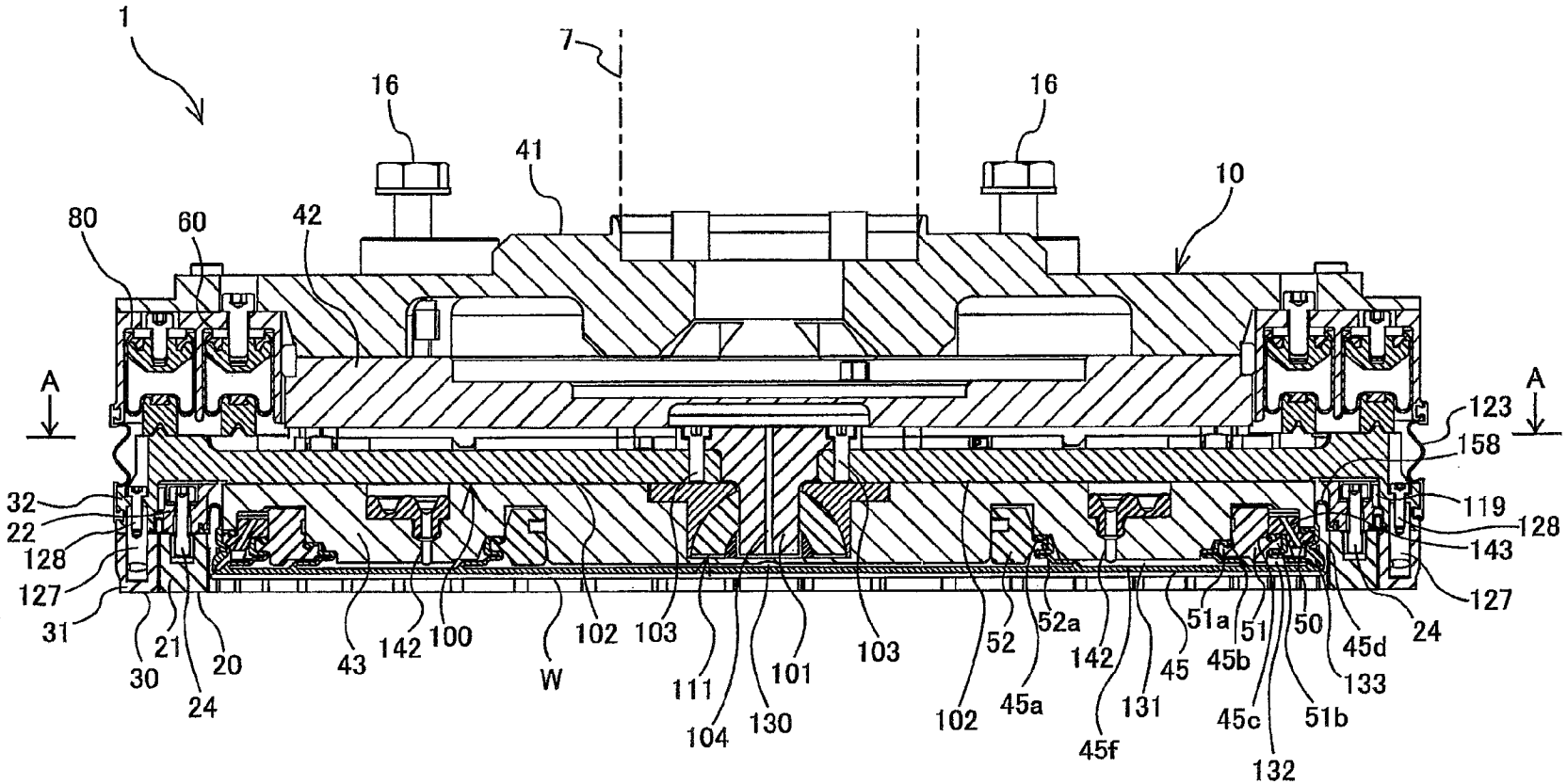
FIG. 2 is a cross-sectional view of the top ring shown in FIG. 1.
Figure 3:
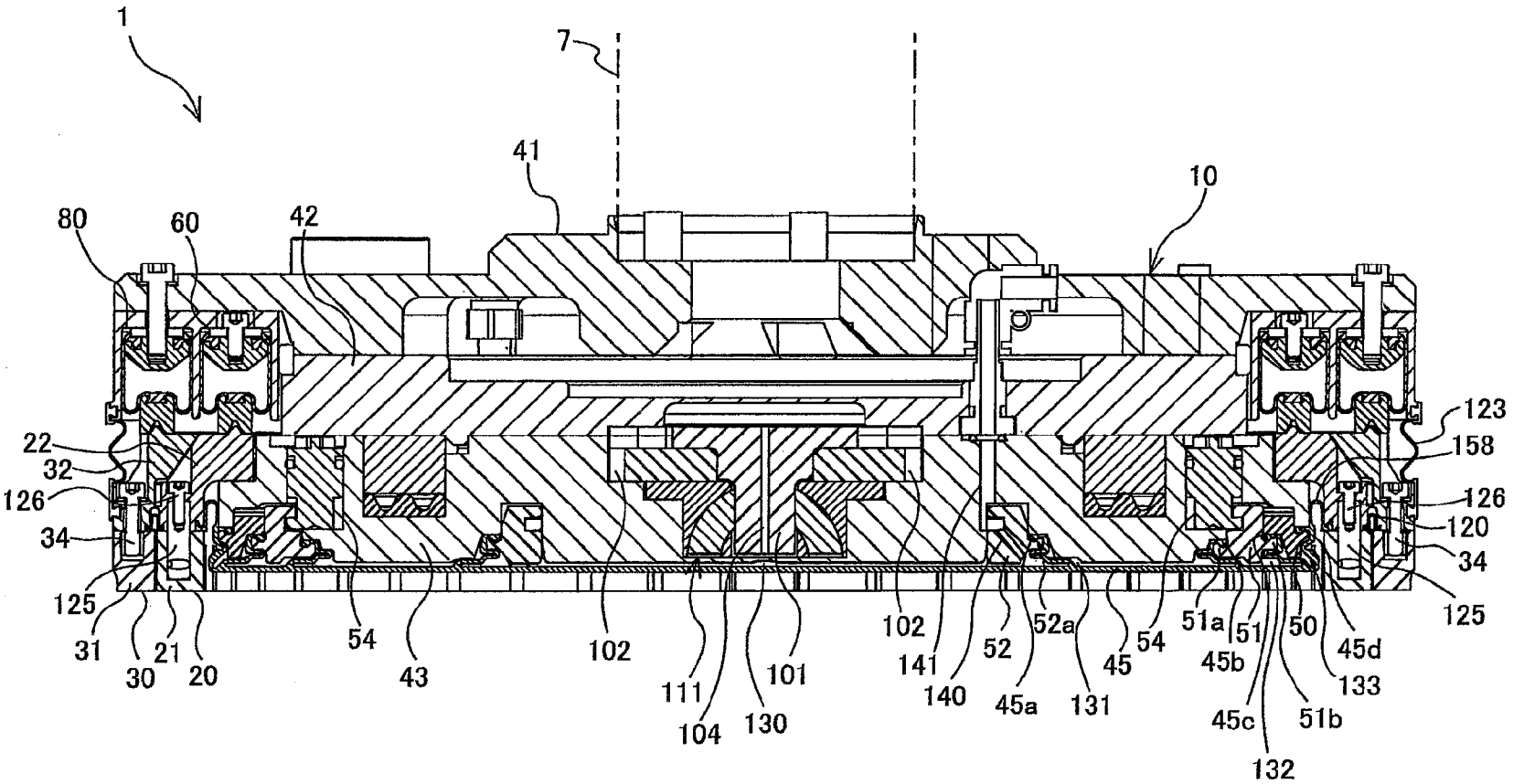
FIG. 3 is another cross-sectional view of the top ring.
Figure 4:
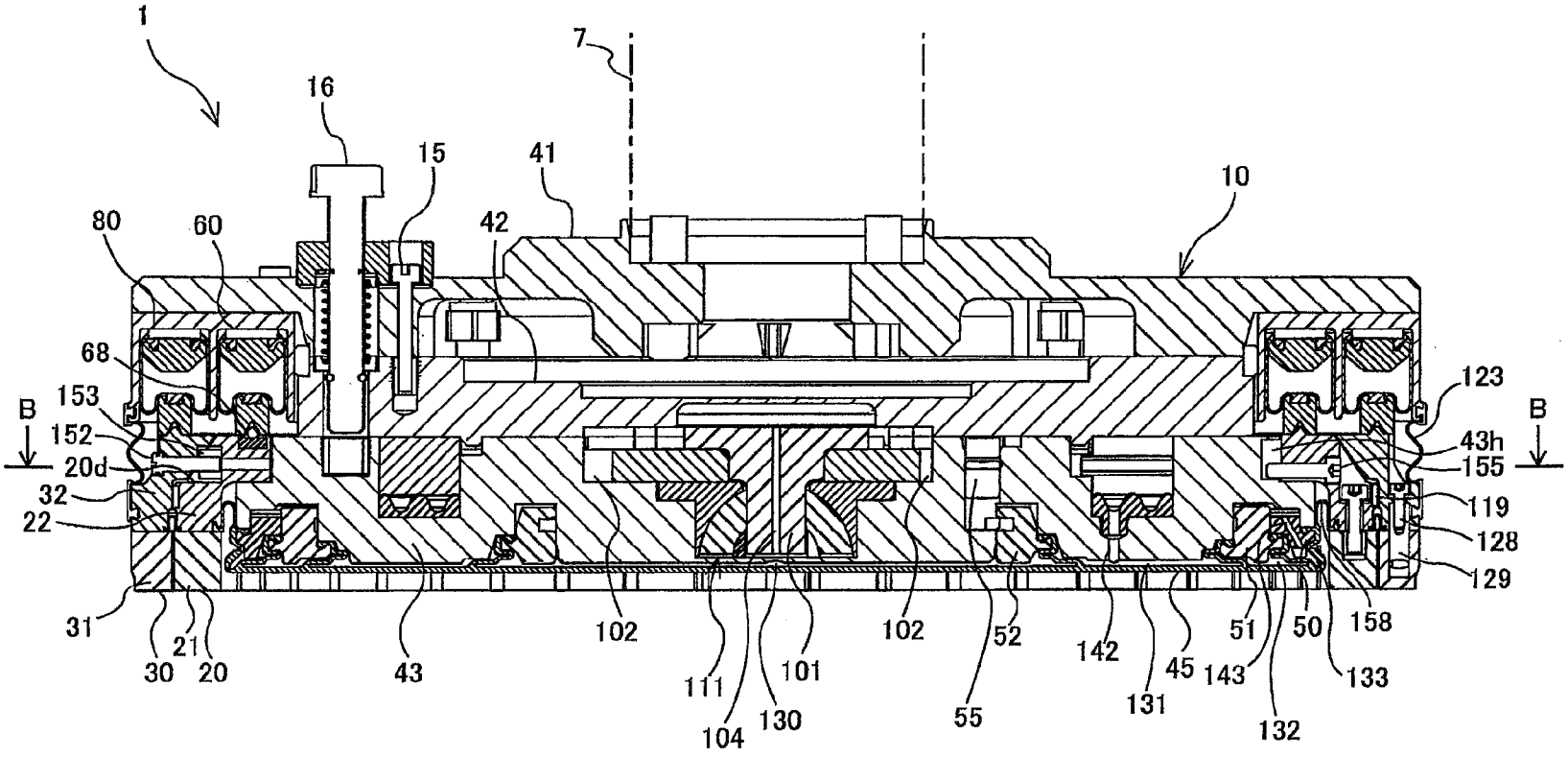
FIG. 4 is still another cross-sectional view of the top ring.
Figure 5:
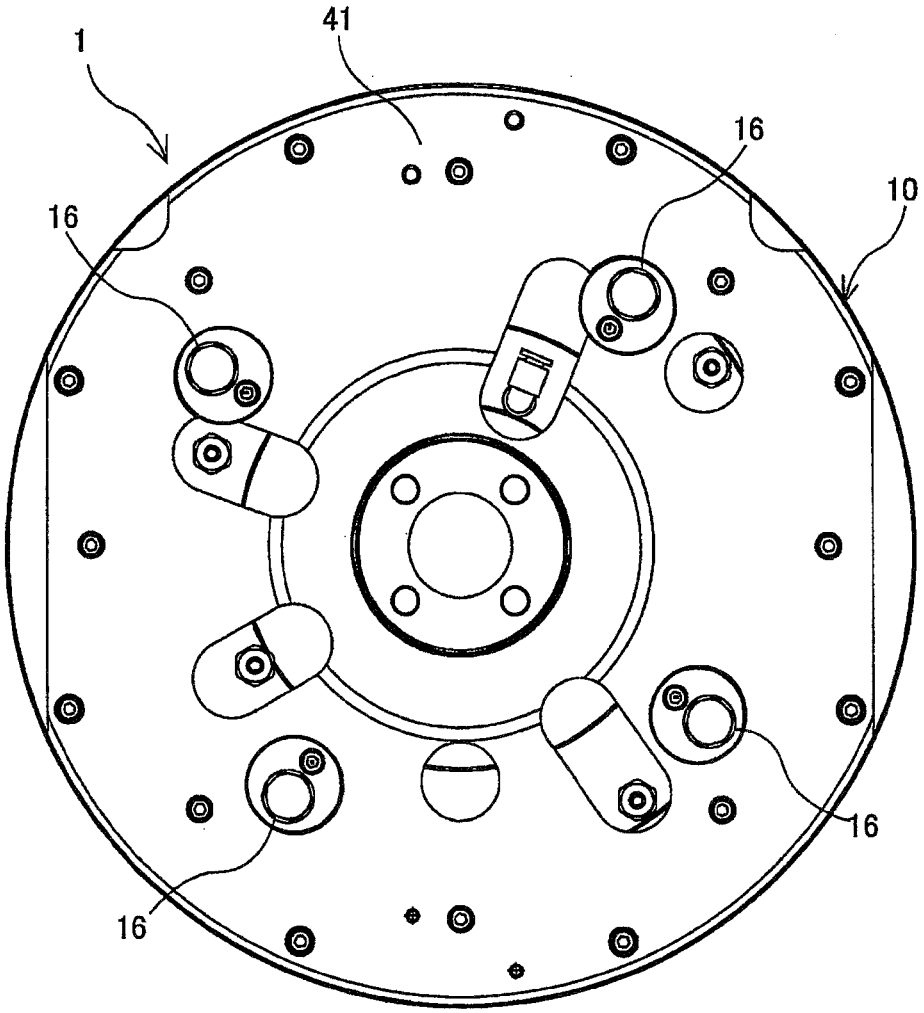
FIG. 5 is a plan view of the top ring.
Figure 6:
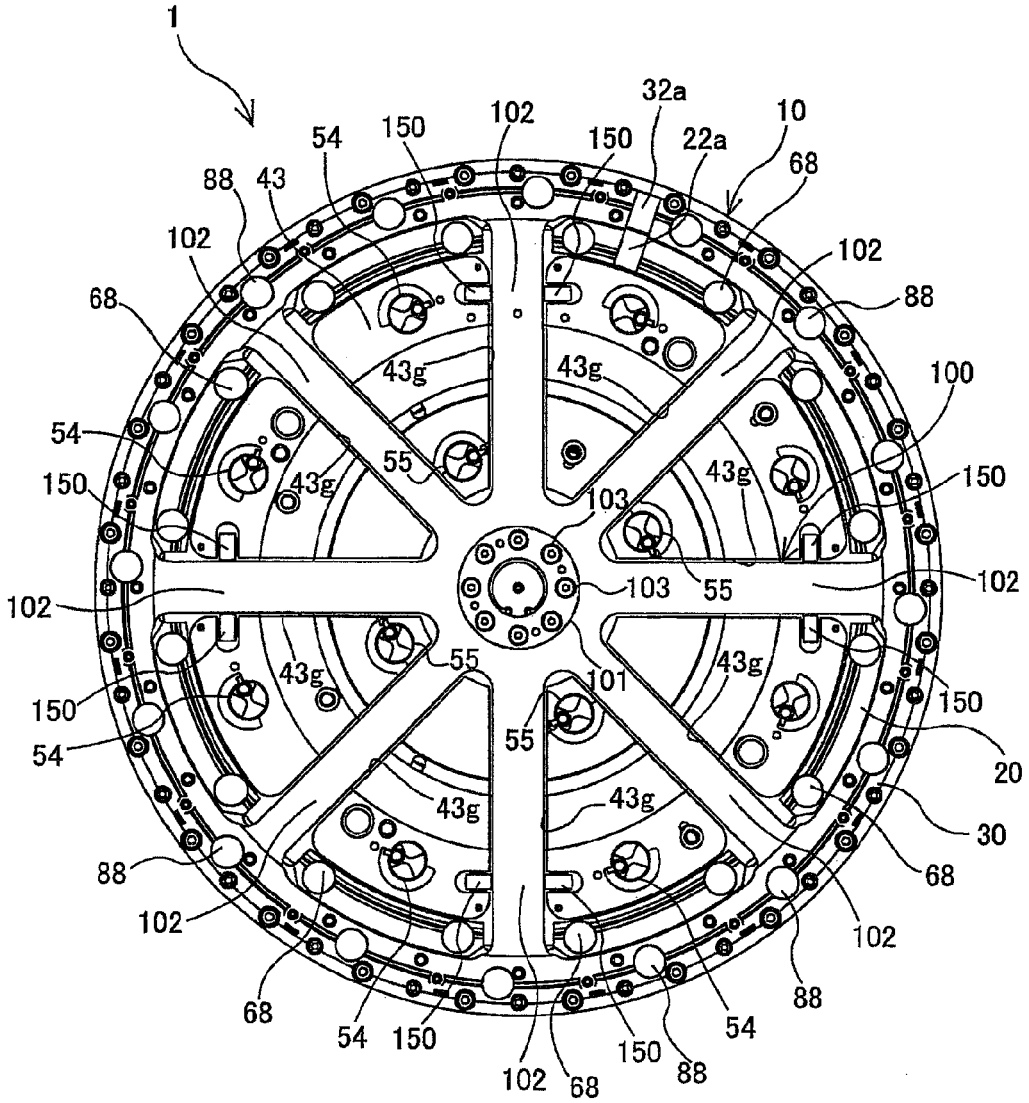
FIG. 6 is a cross-sectional view taken along line A-A in FIG. 2.
Figure 7:
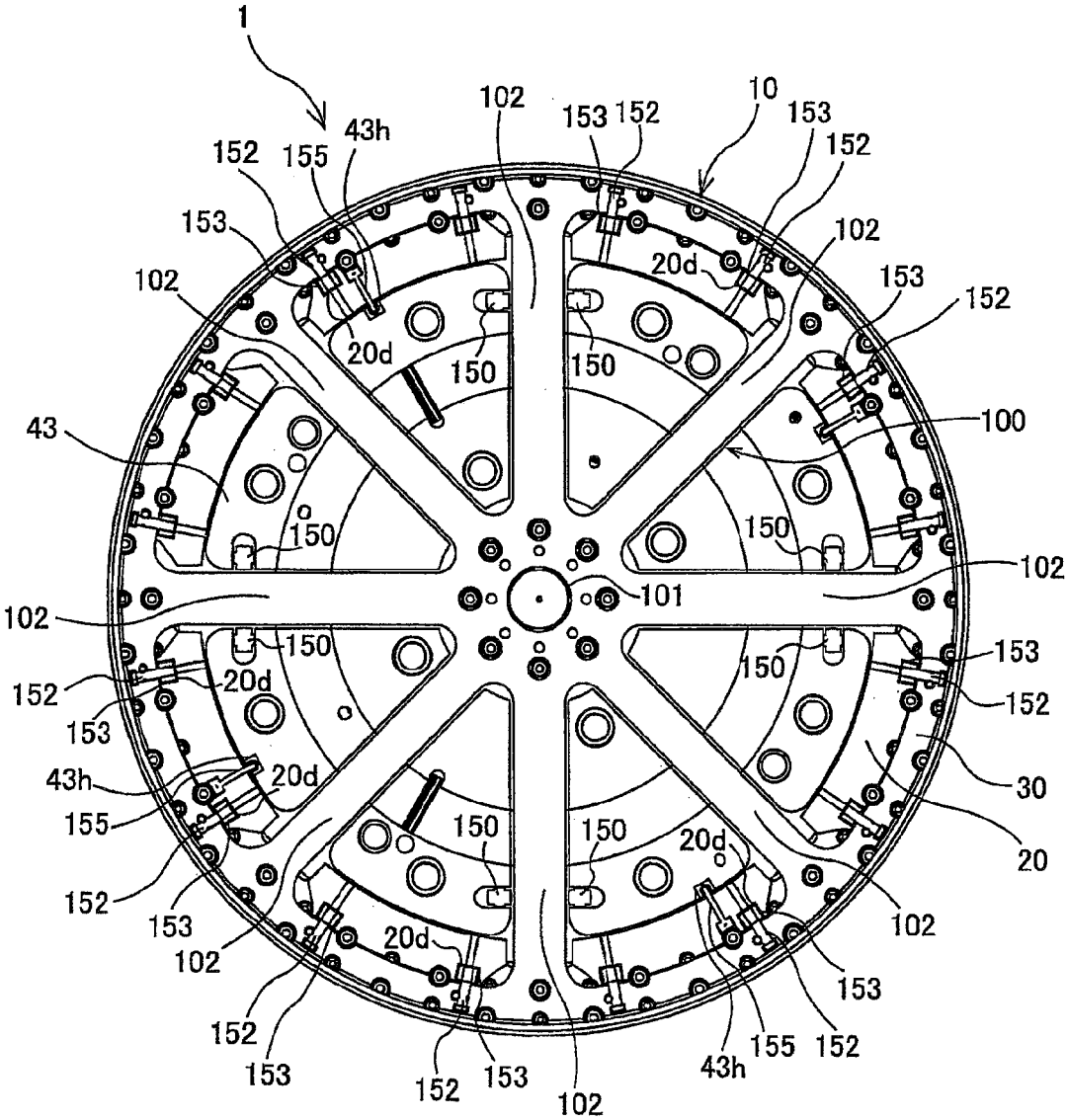
FIG. 7 is a cross-sectional view taken along line B-B in FIG. 4.

The top ring 1, which serves as a substrate holder, will be described in detail below. FIGS. 2 through 4 are cross-sectional views, taken along different radial planes, of the top ring 1 which is configured to hold the wafer W and press the wafer W against the polishing surface 2*a* of the polishing pad 2 on the polishing table 3. FIG. 5 is a plan view of the top ring 1, FIG. 6 is a cross-sectional view taken along line A-A in FIG. 2, and FIG. 7 is a cross-sectional view taken along line B-B in FIG. 4.

The top ring 1 includes: a top ring body 10 for pressing the wafer W against the polishing surface 2*a*; an inner retaining ring 20 arranged so as to surround the wafer W; and an outer retaining ring 30 arranged so as to surround the inner retaining ring 20. The top ring body 10, the inner retaining ring 20, and the outer retaining ring 30 are rotatable in unison by the rotation of the top ring shaft 7. The inner retaining ring 20 is located radially outwardly of the top ring body 10, and the outer retaining ring 30 is located radially outwardly of the inner retaining ring 20. The inner retaining ring 20 is configured to be vertically movable independently of the top ring body 10 and the outer retaining ring 30. The outer retaining ring 30 is configured to be vertically movable independently of the top ring body 10 and the inner retaining ring 20.

The top ring body 10 has: a circular flange 41; a spacer 42 mounted on a lower surface of the flange 41; and a carrier 43 mounted on a lower surface of the spacer 42. The flange 41 is coupled to the top ring shaft 7 by bolts (not shown). As shown in FIG. 4, the spacer 42 is secured to the flange 41 by bolts 15. The carrier 43 is secured to the spacer 42 by maintenance bolts 16. FIG. 4 shows a state in which the maintenance bolts 16 are removed from the carrier 43. The top ring body 10, which is constructed by the flange 41, the spacer 42, and the carrier 43, is made of resin, such as engineering plastic (e.g., PEEK). The flange 41 may be made of metal, such as SUS, aluminum, or the like.

A flexible membrane 45, which is brought into contact with a back surface of the wafer W, is attached to a lower surface of the carrier 43. This flexible membrane 45 is secured to the lower surface of the carrier 43 by an annular edge holder 50 and annular ripple holders 51 and 52. The edge holder 50 is disposed on a peripheral portion of the carrier 43, and the ripple holders 51 and 52 are disposed inwardly of the edge holder 50. The flexible membrane 45 is made of a highly strong and durable rubber material, such as ethylene propylene rubber (EPDM), polyurethane rubber, silicone rubber, or the like.

Figure 8:
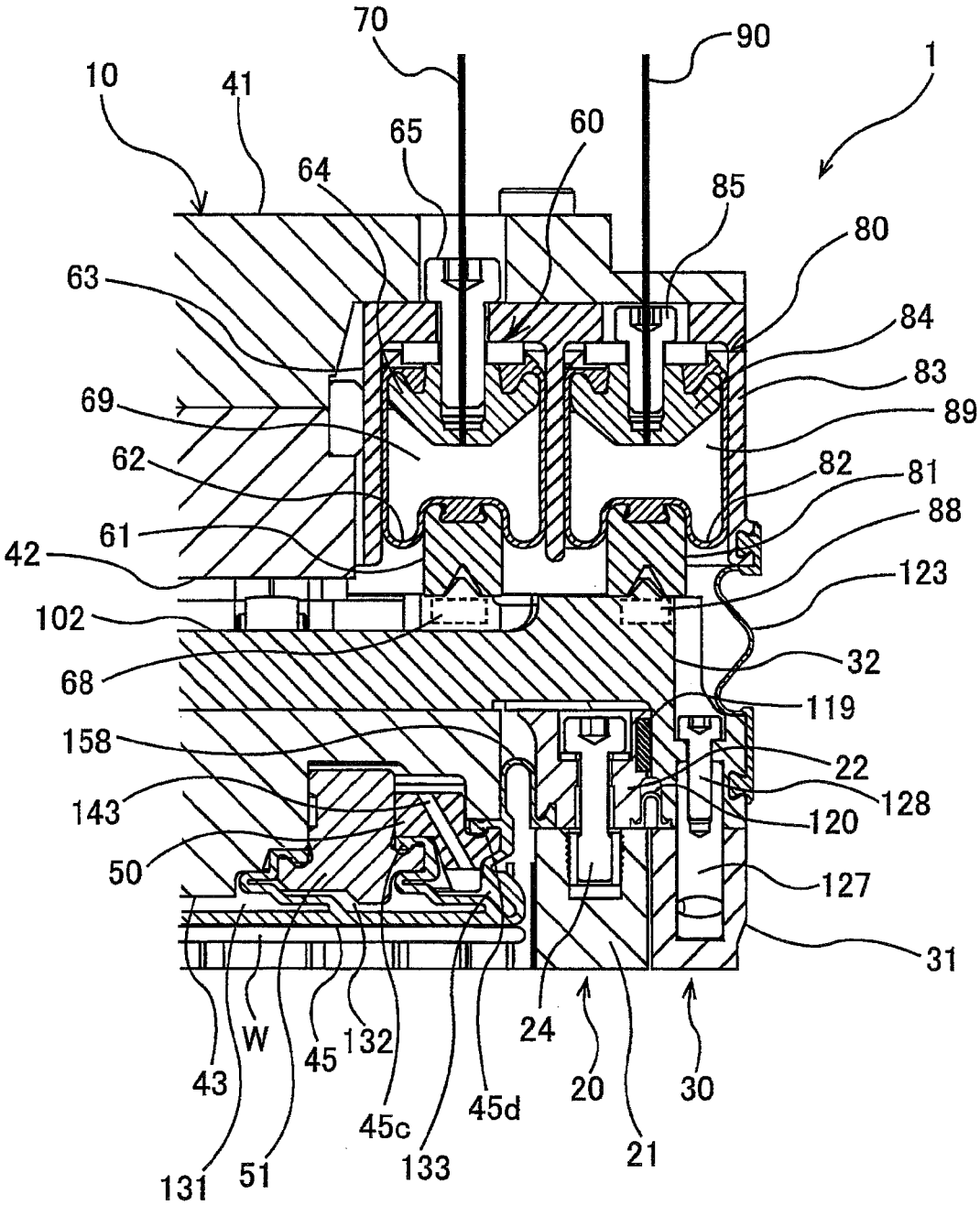
FIG. 8 is an enlarged fragmentary cross-sectional view of the top ring shown in FIG. 1.

FIG. 8 is an enlarged fragmentary cross-sectional view of the inner retaining ring 20 and the outer retaining ring 30 shown in FIG. 2. As shown in FIG. 8, the inner retaining ring 20 is disposed at a periphery of the top ring body 10. The inner retaining ring 20 has: an inner ring member 21 that contacts the polishing surface 2*a* (see FIG. 1) of the polishing pad 2; and an inner drive ring 22 fixed to an upper portion of the inner ring member 21. The inner ring member 21 is secured to the inner drive ring 22 by a plurality of bolts 24. The inner ring member 21 is arranged so as to surround a peripheral edge of the wafer W and retains the wafer W therein so as to prevent the wafer W from being separated from the top ring 1 when the wafer W is being polished.

The inner retaining ring 20 has an upper portion coupled to an inner pressing mechanism 60, which is configured to press a lower surface of the inner retaining ring 20 (i.e., a lower surface of the inner ring member 21) against the polishing surface 2*a* of the polishing pad 2. The inner drive ring 22 is made of metal, such as SUS, or ceramic, and the inner ring member 21 is made of resin, such as PEEK, PPS, or the like.

The inner pressing mechanism 60 includes: an inner piston 61 fixed to an upper portion of the inner drive ring 22; an inner rolling diaphragm 62 connected to an upper surface of the inner piston 61; and an inner cylinder 63 housing the inner rolling diaphragm 62 therein. The inner rolling diaphragm 62 has upper ends held by a holding member 64, which is fixed to an upper portion of the inner cylinder 63 by bolts 65.

The inner retaining ring 20 is removably coupled to the inner pressing mechanism 60. More specifically, the inner piston 61 is made of a magnetic material, such as metal, and a plurality of magnets 68 are disposed on the upper portion of the inner drive ring 22. These magnets 68 magnetically attract the inner piston 61, so that the inner retaining ring 20 is magnetically secured to the inner piston 61. The magnetic material of the inner piston 61 may be corrosion resisting magnetic stainless steel, for example. Alternatively, the inner drive ring 22 may be made of a magnetic material, and magnets may be disposed on the inner piston 61.

The inner rolling diaphragm 62 is shaped so as to form an inner pressure chamber 69 therein. This inner pressure chamber 69 is coupled to a fluid supply source (not shown) through a fluid passage 70 which is schematically depicted in the drawing. When the fluid supply source supplies a pressurized fluid (e.g., pressurized air) into the inner pressure chamber 69, the inner rolling diaphragm 62 pushes down the inner piston 61, which in turn pushes down the inner retaining ring 20. In this manner, the inner pressing mechanism 60 presses the lower surface of the inner retaining ring 20 (i.e., the lower surface of the inner ring member 21) against the polishing surface 2*a* of the polishing pad 2. The inner pressure chamber 69 is further coupled to a vacuum pump, not shown. When the vacuum pump develops a negative pressure in the inner pressure chamber 69, the inner retaining ring 20 is elevated. The inner pressure chamber 69 is also coupled to a relief mechanism (not shown), so that the inner pressure chamber 69 can be vented to the atmosphere.

The outer retaining ring 30 is arranged around the inner retaining ring 20. The outer retaining ring 30 has: an outer ring member 31 that contacts the polishing surface 2*a* of the polishing pad 2; and an outer drive ring 32 fixed to an upper portion of the outer ring member 31. The outer ring member 31 is secured to the outer drive ring 32 by a plurality of bolts 34 (see FIG. 3). The outer ring member 31 is disposed so as to surround the inner ring member 21 of the inner retaining ring 20. The inner ring member 21 and the outer ring member 31 are kept out of contact with each other at all times with a gap formed between the inner ring member 21 and the outer ring member 31.

The outer retaining ring 30 has an upper portion coupled to an outer pressing mechanism 80, which is configured to press a lower surface of the outer retaining ring 30 (i.e., a lower surface of the outer ring member 31) against the polishing surface 2*a* of the polishing pad 2. The outer drive ring 32 is made of metal, such as SUS, or ceramic, and the outer ring member 31 is made of resin, such as PEEK, PPS, or the like.

The outer pressing mechanism 80 includes: an outer piston 81 fixed to an upper portion of the outer drive ring 32; an outer rolling diaphragm 82 connected to an upper surface of the outer piston 81; and an outer cylinder 83 housing the outer rolling diaphragm 82 therein. The outer rolling diaphragm 82 has upper ends held by a holding member 84, which is fixed to an upper portion of the outer cylinder 83 by bolts 85. In this embodiment, the inner cylinder 63 and the outer cylinder 83 are integrally formed.

The outer retaining ring 30 is removably coupled to the outer pressing mechanism 80. More specifically, the outer piston 81 is made of a magnetic material, such as metal, and a plurality of magnets 88 are disposed on the upper portion of the outer drive ring 32. These magnets 88 magnetically attract the outer piston 81, so that the outer retaining ring 30 is magnetically secured to the outer piston 81. Alternatively, the outer drive ring 32 may be made of a magnetic material, and magnets may be disposed on the outer piston 81.

The outer rolling diaphragm 82 is shaped so as to form an outer pressure chamber 89 therein. This outer pressure chamber 89 is coupled to the above-described fluid supply source through a fluid passage 90 which is schematically depicted in the drawing. When the fluid supply source supplies the pressurized fluid (e.g., pressurized air) into the outer pressure chamber 89, the outer rolling diaphragm 82 pushes down the outer piston 81, which in turn pushes down the outer retaining ring 30. In this manner, the outer pressing mechanism 80 presses the lower surface of the outer retaining ring 30 (i.e., the lower surface of the outer ring member 31) against the polishing surface 2*a* of the polishing pad 2. The outer pressure chamber 89 is further coupled to the vacuum pump. When the vacuum pump develops a negative pressure in the outer pressure chamber 89, the outer retaining ring 30 is elevated. The outer pressure chamber 89 is also coupled to a relief mechanism (not shown), so that the outer pressure chamber 89 can be vented to the atmosphere.

During polishing of the wafer, the flexible membrane 45 presses the wafer W against the polishing surface 2*a* of the polishing pad 2, while the inner retaining ring 20 and the outer retaining ring 30 directly press the polishing surface 2*a* of the polishing pad 2. The inner retaining ring 20 and the outer retaining ring 30 are configured to be movable independently of each other in the vertical direction relative to the top ring body 10, and are coupled respectively to the inner pressing mechanism 60 and the outer pressing mechanism 80. With these arrangements, the inner pressing mechanism 60 and the outer pressing mechanism 80 can separately press the inner retaining ring 20 and the outer retaining ring 30 against the polishing surface 2*a* of the polishing pad 2.

As shown in FIG. 2, the outer retaining ring 30 is coupled to a spherical bearing 111 through a coupling member 100. The spherical bearing 111 is disposed radially inwardly of the inner retaining ring 20. The coupling member 100 includes: a vertically extending shaft portion 101 disposed centrally in the top ring body 10; and a plurality of spokes 102 extending radially from the shaft portion 101. The spokes 102 have one ends fixed to the shaft portion 101 by a plurality of bolts 103, and have the other ends fixed to the outer drive ring 32 of the outer retaining ring 30. In this embodiment, the spokes 102 and the outer drive ring 32 are formed integrally.

The shaft portion 101 of the coupling member 100 is supported by the spherical bearing 111 such that the shaft portion 101 can be movable in the vertical direction. The spherical bearing 111 is located at the center of the top ring body 10. The coupling member 100 and the outer retaining ring 30 that is secured to the coupling member 100 are thus vertically movable relative to the top ring body 10. The shaft portion 101 has a vertically extending through-hole 104 formed therein. This through-hole 104 acts as an air vent hole when the shaft portion 101 moves vertically relative to the spherical bearing 111. Therefore, the outer retaining ring 30 can move smoothly in the vertical direction relative to the top ring body 10.

Figure 9:
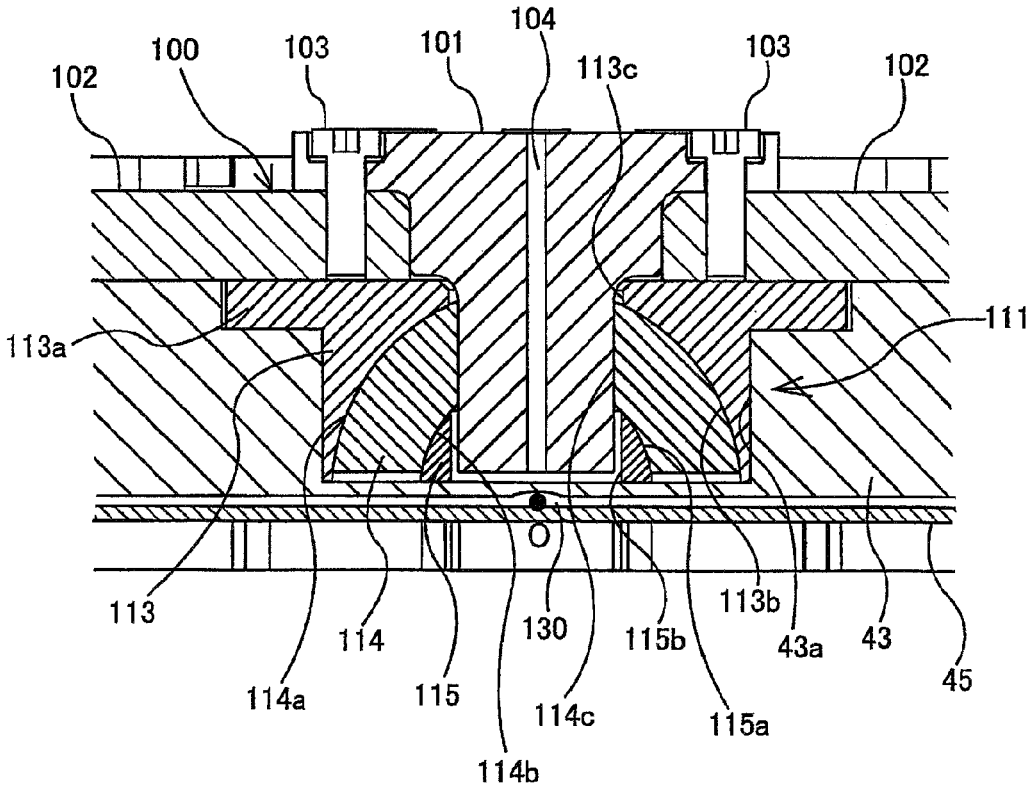
FIG. 9 is an enlarged cross-sectional view of a spherical bearing.

FIG. 9 is an enlarged cross-sectional view of the spherical bearing 111. As shown in FIG. 9, the spherical bearing 111 includes: an intermediate bearing ring 114 coupled to the outer retaining ring 30 through the coupling member 100; an outer bearing ring 113 slidably supporting the intermediate bearing ring 114 from above; and an inner bearing ring 115 slidably supporting the intermediate bearing ring 114 from below. The intermediate bearing ring 114 is in the form of a partial spherical shell smaller than an upper half of a spherical shell. The intermediate bearing ring 114 is sandwiched between the outer bearing ring 113 and the inner bearing ring 115.

The carrier 43 has a recess 43*a* formed at the central portion thereof, and the outer bearing ring 113 is disposed in this recess 43*a*. The outer bearing ring 113 has a flange portion 113*a* on its outer circumferential surface. The flange portion 113*a* is secured to a step of the recess 43*a* by bolts (not shown), thereby securing the outer bearing ring 113 to the carrier 43 and applying pressure to the intermediate bearing ring 114 and the inner bearing ring 115. The inner bearing ring 115 is disposed on a bottom surface of the recess 43*a*. This inner bearing ring 115 supports the intermediate bearing ring 114 from below so as to form a gap between a lower surface of the intermediate bearing ring 114 and the bottom surface of the recess 43*a*.

The outer bearing ring 113 has an inner surface 113*b*, the intermediate bearing ring 114 has an outer surface 114*a* and an inner surface 114*b*, and the inner bearing ring 115 has an outer surface 115*a*. Each of these surfaces 113*b*, 114*a*, 114*b*, and 115*a* is a substantially hemispheric surface whose center is represented by a fulcrum O. The outer surface 114*a* of the intermediate bearing ring 114 slidably contacts the inner surface 113*b* of the outer bearing ring 113. The inner surface 114*b* of the intermediate bearing ring 114 slidably contacts the outer surface 115*a* of the inner bearing ring 115. The inner surface 113*b* (sliding contact surface) of the outer bearing ring 113, the outer surface 114*a* and the inner surface 114*b* (sliding contact surfaces) of the intermediate bearing ring 114, and the outer surface 115*a* (sliding contact surface) of the inner bearing ring 115 have a partial spherical shape smaller than an upper half of a spherical surface. With these configurations, the intermediate bearing ring 114 is tiltable in all directions through 360° with respect to the outer bearing ring 113 and the inner bearing ring 115. The fulcrum O, which is the center of the tilting movement of the intermediate bearing ring 114, is located below the spherical bearing 111.

The outer bearing ring 113, the intermediate bearing ring 114, and the inner bearing ring 115 have respective through-holes 113*c*, 114*c*, and 115*c* formed therein in which the shaft portion 101 is inserted. There is a gap between the through-hole 113*c* of the outer bearing ring 113 and the shaft portion 101. Similarly, there is a gap between the through-hole 115*b* of the inner bearing ring 115 and the shaft portion 101. The through-hole 114*c* of the intermediate bearing ring 114 has a diameter smaller than those of the through-holes 113*c* and 115*b* of the outer bearing ring 113 and the inner bearing ring 115, so that the shaft portion 101 is movable relative to the intermediate bearing ring 114 only in the vertical direction. Therefore, the outer retaining ring 30, which is coupled to the shaft portion 101, is substantially not allowed to move laterally, i.e., horizontally. That is, the outer retaining ring 30 is fixed in its lateral position (i.e., its horizontal position) by the spherical bearing 111.

Figure 10A:
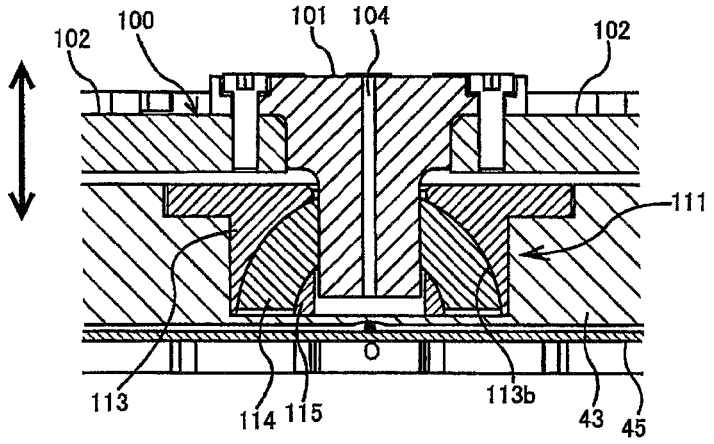
FIG. 10A is a cross-sectional view showing the manner in which a shaft portion is vertically moved relative to the spherical bearing.
Figure 10B:
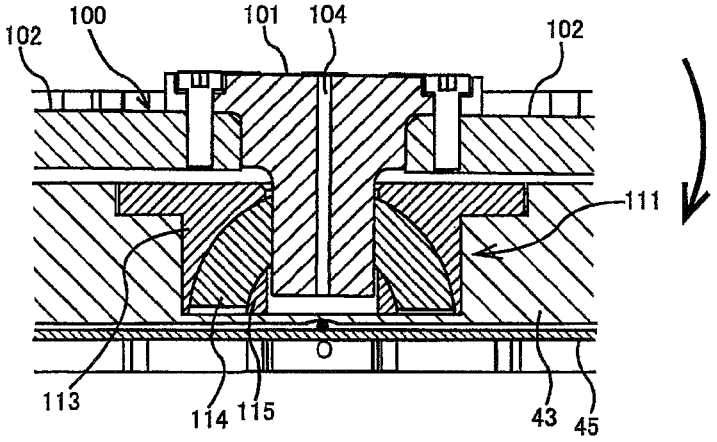
FIG. 10B is a cross-sectional view showing the manner in which the shaft portion tilts in unison with an intermediate bearing ring.
Figure 10C:
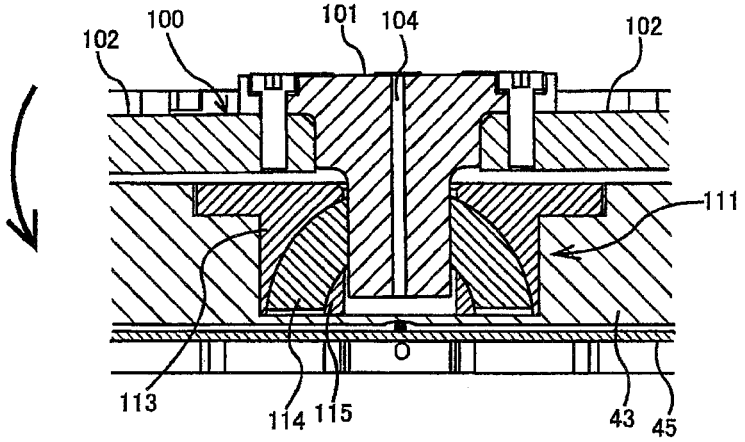
FIG. 10C is a cross-sectional view showing the manner in which the shaft portion tilts in unison with the intermediate bearing ring.

FIG. 10A shows the manner in which the shaft portion 101 is vertically moved relative to the spherical bearing 111, and FIGS. 10B and 10C show the manner in which the shaft portion 101 tilts in unison with the intermediate bearing ring 114. As shown in FIGS. 10A through 10C, the outer retaining ring 30, which is coupled to the shaft portion 101, is tiltable in unison with the intermediate bearing ring 114 around the fulcrum O and is vertically movable relative to the intermediate bearing ring 114. The fulcrum O, which is the center of the tilting movement, lies on a central axis of the outer retaining ring 30.

The spherical bearing 111 allows the outer retaining ring 30 to move vertically and tilt, while restricting the lateral movement (i.e., the horizontal movement) of the outer retaining ring 30 so as not to permit transmission of a lateral force from the outer retaining ring 30 to the inner retaining ring 20. A ring-shaped stopper 119 is disposed between the outer retaining ring 30 and the inner retaining ring 20. During polishing of the wafer, the inner retaining ring 20 receives a lateral force from the wafer (i.e., a force in a radially outward direction of the wafer). This lateral force is generated due to friction between the wafer and the polishing pad 2. The lateral force is transmitted from the inner retaining ring 20 to the outer retaining ring 30 through the stopper 119, and is finally supported by the spherical bearing 111. Therefore, the spherical bearing 111 serves as a supporting mechanism capable of supporting the lateral force (i.e., the force in the radially outward direction of the wafer) applied to the inner retaining ring 20 from the wafer due to the friction between the wafer and the polishing pad 2 and capable of restricting the lateral movement of the outer retaining ring 30 (i.e., capable of fixing the horizontal position of the outer retaining ring 30).

The outer retaining ring 30 is tiltable about the fulcrum O and supported by the spherical bearing 111 such that the outer retaining ring 30 is vertically movable on an axis passing through the fulcrum O. In the embodiment shown in FIG. 9, the fulcrum O is located slightly above the polishing surface 2*a* when polishing the wafer. When the wafer is polished, the fulcrum O should preferably be located upwardly from the polishing surface 2*a* by a distance in a range of 0 to 40 mm. During polishing of the wafer, the lateral force (i.e., the horizontal force) is exerted on the inner retaining ring 20 from the wafer due to the friction between the wafer and the polishing pad 2. This lateral force is borne through the outer retaining ring 30 by the spherical bearing 111 located above the center of the wafer.

Figure 11:
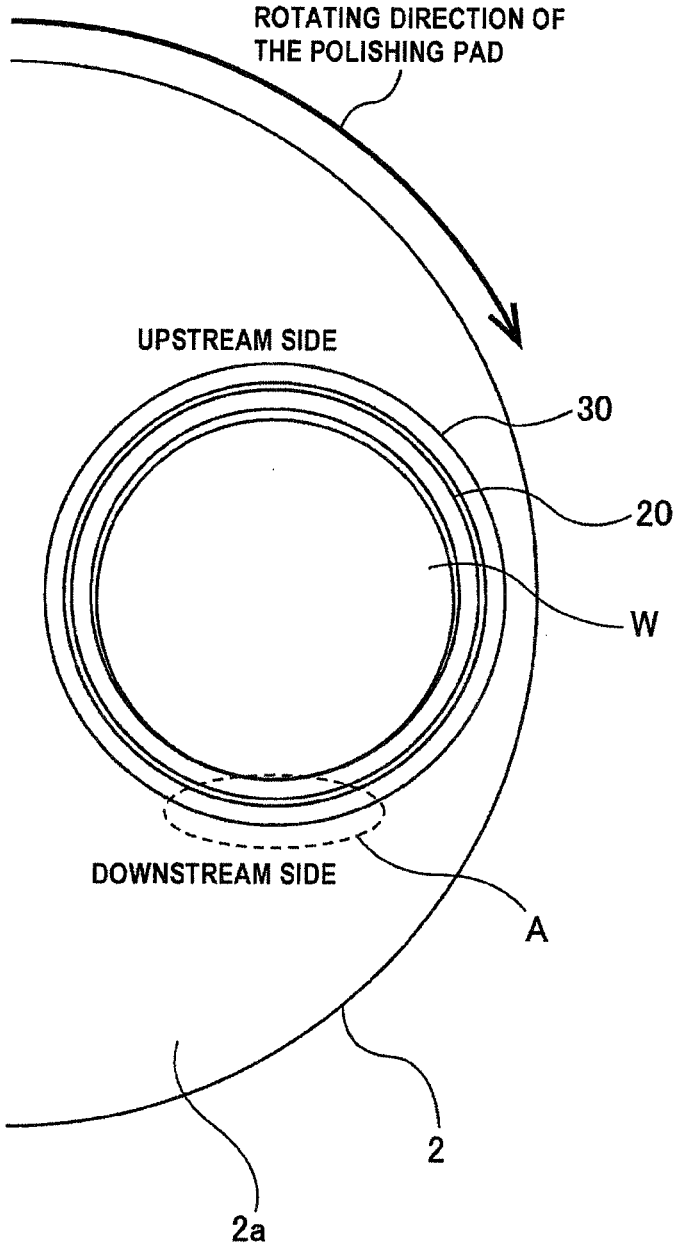
FIG. 11 is a plan view of a polishing pad, a wafer, an inner retaining ring, and an outer retaining ring.

The outer retaining ring 30, which is receiving the above-described lateral force (i.e., the frictional force produced between the wafer and the polishing pad 2) through the inner retaining ring 20, is allowed to tilt smoothly by the spherical bearing 111. Specifically, the outer retaining ring 30 tilts in a direction to sink into the polishing pad 2 in the upstream of the wafer with respect to the rotating direction (indicated by the arrow in FIG. 11) of the polishing surface 2*a* and tilts in a direction to rise from the polishing pad 2 in the downstream of the wafer. If the load on the outer retaining ring 30 inclined in this manner is changed (e.g., increased), a load on the polishing surface 2*a* changes most significantly in a region (see symbol A in FIG. 11) located downstream of the wafer. Therefore, by positively allowing the outer retaining ring 30 to tilt around the fulcrum O of the spherical bearing 111, it is possible to change a polishing profile of the wafer in its downstream-side edge portion which is most likely to be affected by the change in the load because a polishing speed (polishing rate) of this portion is originally high. As a result, the polishing profile of the overall edge portion of the wafer can be controlled by the control of the load on the outer retaining ring 30. Moreover, since the outer retaining ring 30 is vertically movably supported by the spherical bearing 111, it is possible to increase an allowable amount of wear of the outer retaining ring 30 and hence to increase the lifetime of the outer retaining ring 30.

The outer retaining ring 30 can improve the controllability of the polishing profile of the edge portion of the wafer. The edge portion of the wafer is an outermost peripheral region of the wafer with a width of about 3 mm. The polishing profile of the wafer edge portion can be controlled by pressing the polishing pad 2 outside of the inner retaining ring 20 with the outer retaining ring 30 during polishing of the wafer. The gap between the inner retaining ring 20 and the outer retaining ring 30 may be changed in order to control such a polishing-pad rebound effect produced by the outer retaining ring 30. The gap between the inner retaining ring 20 and the outer retaining ring 30 (or more specifically the gap between the lower surface of the inner retaining ring 20 and the lower surface of the outer retaining ring 30) is preferably in the range of 0.1 mm to 3 mm.

By controlling the load exerted on the polishing surface 2*a* from the outer retaining ring 30, the polishing profile of the edge portion of the wafer (i.e., the peripheral region extending inwardly from the outermost wafer edge by a distance of about 3 mm) can be controlled. Further, by controlling the load exerted on the polishing surface 2*a* from the inner retaining ring 20, the polishing profile can be controlled in a relatively wide region (e.g., a peripheral region extending inwardly from the outermost wafer edge by a distance of about 15 mm) including the edge portion of the wafer.

A frictional force generated by the sliding contact between the outer retaining ring 30 itself and the polishing surface 2*a* is considerably smaller than the frictional force generated between the wafer and the polishing surface 2*a* because an area of contact between the outer retaining ring 30 and the polishing surface 2*a* is small. A frictional force is also generated by the sliding contact between the inner retaining ring 20 and the polishing surface 2*a*. This frictional force acting on the inner retaining ring 20 is transmitted to the outer retaining ring 30 through the stopper 119 which is disposed between the outer retaining ring 30 and the inner retaining ring 20, and is finally supported by the spherical bearing 111 that serves as the supporting mechanism for supporting the outer retaining ring 30. The stopper 119, which is of a ring shape, is mounted on an outer circumferential surface of the inner drive ring 22. Alternatively, the stopper 119 may be mounted on an inner circumferential surface of the outer drive ring 32. The stopper 119 should preferably be made of resin material having an excellent slidability. The stopper 119 has a sliding contact surface which may have a straight or curved vertical cross-sectional shape. The stopper 119 may be integral with the inner drive ring 22 or the outer drive ring 32.

At least one of the outer bearing ring 113, the intermediate bearing ring 114, the inner bearing ring 115 of the spherical bearing 111, and the shaft portion 101 of the coupling member 100 is preferably made of ceramic, such as SiC or zirconia. Only the sliding contact surfaces of these components may be made of ceramic. For example, the sliding contact surface of the outer bearing ring 113 may be made of ceramic, while the other portion thereof may be made of metal. Use of the ceramic can make the sliding contact surface more resistant to wear and can reduce surface roughness of the sliding contact surface to thereby reduce the friction of the sliding contact surface. In order to reduce the friction of the sliding contact surfaces of the outer bearing ring 113, the intermediate bearing ring 114, the inner bearing ring 115, and the shaft portion 101, these sliding contact surfaces may be covered with a layer containing Teflon (registered trademark) which has a high self-lubricating capability, a low coefficient of friction, and an excellent wear resistance. Furthermore, at least one of the sliding contact surfaces of the outer bearing ring 113, the intermediate bearing ring 114, the inner bearing ring 115, and the shaft portion 101 may be made of a low-friction material which may be a resin material, such as PTFE (polytetrafluoroethylene), PEEK (polyether ether ketone), or PPS (polyphenylene sulfide). Alternatively, the sliding contact surface may be made of resin material containing fibers, such as carbon fibers, and a solid lubricant.

It is possible to use metal having a low coefficient of friction and an excellent wear resistance for the outer bearing ring 113, the intermediate bearing ring 114, the inner bearing ring 115, and the shaft portion 101. However, when a metal film on the wafer W is polished, an eddy current sensor may be used to measure a thickness of the metal film during polishing. If the spherical bearing 111 near the wafer includes the metal which is a conductive material, measurement accuracy of the eddy current sensor may be lowered. Therefore, the spherical bearing 111 and the shaft portion 101 should preferably be made of non-conductive material.

The outer retaining ring 30 is configured to be tiltable independently of the top ring body 10 and the inner retaining ring 20. Since the spherical bearing 111, which supports the outer retaining ring 30 tiltably and vertically movably, is arranged in the top ring body 10 and housed in the recess 43*a* of the carrier 43, wear debris produced from the sliding contact surfaces of the spherical bearing 111 is confined in the top ring body 10 and does not fall onto the polishing surface 2*a*.

As shown in FIG. 3, a plurality of reinforcing pins (reinforcing members) 125 are embedded in the inner retaining ring 20. These reinforcing pins 125 are arranged at equal intervals along the circumferential direction of the inner retaining ring 20. The reinforcing pins 125 extend vertically and are fastened to the inner drive ring 22 by respective bolts 126. The reinforcing pins 125 have their lower ends located in the vicinity of the lower end of the inner ring member 21, and have their upper ends located in the inner drive ring 22. The reinforcing pins 125 may be made of metal, such as stainless steel, or ceramic. These reinforcing pins 125 embedded in the inner retaining ring 20 serve to increase rigidity of the inner retaining ring 20. Therefore, any deformation of the inner retaining ring 20 under the lateral force, which is applied from the wafer to the inner retaining ring 20 when the wafer is being polished, is minimized. As a result, the inner retaining ring 20 can press the polishing pad 2 more uniformly.

The reinforcing pins 125 are removably secured to the inner drive ring 22 by the bolts 126. This configuration has the following advantages. In order to increase the rigidity of the inner retaining ring 20, a difference between a diameter of the reinforcing pins 125 and a diameter of insertion holes formed the inner ring member 21 into which the reinforcing pins 125 are fitted should preferably be as small as possible. Further, it is highly important to position the reinforcing pins 125 in exact alignment with the insertion holes in the inner ring member 21. If the inner ring member 21 is mounted on the inner drive ring 22 with the reinforcing pins 125 in slightly out of alignment with the insertion holes, the inner ring member 21 would be distorted, failing to press the polishing pad 2 uniformly. In order to avoid such a distortion, the inner ring member 21 is installed on the inner drive ring 22 according to the following steps. First, the bolts 126 for fastening the reinforcing pins 125 are temporarily loosely screwed into the reinforcing pins 125 so that the reinforcing pins 125 can be slightly movable horizontally. Then, the reinforcing pins 125 are fitted into the respective insertion holes formed in the inner ring member 21. Through these procedures, misalignment between the reinforcing pins 125 and the insertion holes in the inner ring member 21 is eliminated. Thereafter, the bolts 126 are further screwed so as to secure the reinforcing pins 125 tightly. Finally, as shown in FIG. 2, the bolts 24 are tightened to secure the inner ring member 21 to the inner drive ring 22.

As shown in FIG. 2, a plurality of reinforcing pins (reinforcing members) 127 are also embedded in the outer retaining ring 30. The reinforcing pins 127 are arranged at equal intervals along the circumferential direction of the outer retaining ring 30. The reinforcing pins 127 extend vertically and are fastened to the outer drive ring 32 by respective bolts 128. The reinforcing pins 127 have their lower ends located in the vicinity of the lower end of the outer ring member 31, and have their upper ends located in the outer drive ring 32. The reinforcing pins 127 may be made of metal, such as stainless steel, or ceramic. The reinforcing pins 127 embedded in the outer retaining ring 30 serve to increase the rigidity of the outer retaining ring 30. Therefore, any deformation of the outer retaining ring 30 under the lateral force, which is applied from the wafer to the outer retaining ring 30 through the inner retaining ring 20 when the wafer is being polished, is minimized.

In order to increase the rigidity of the outer retaining ring 30, a difference between a diameter of the reinforcing pins 127 and a diameter of insertion holes formed in the outer ring member 31 into which the reinforcing pins 127 are fitted should preferably be as small as possible. Further, it is highly important to position the reinforcing pins 127 in exact alignment with the insertion holes in the outer ring member 31. If the outer ring member 31 is mounted to the outer drive ring 32 with the reinforcing pins 127 in slightly out of alignment with the insertion holes in the outer ring member 31, the outer ring member 31 would be distorted. In order to avoid such a distortion, the outer ring member 31 is installed on the outer drive ring 32 according to the following steps. First, the bolts 128 for fastening the reinforcing pins 127 are temporarily loosely screwed into the reinforcing pins 127 so that the reinforcing pins 127 can be slightly movable horizontally. Then, the reinforcing pins 127 are fitted into the respective insertion holes formed in the outer ring member 31. Through these procedures, misalignment between the reinforcing pins 127 and the insertion holes in the outer ring member 31 is eliminated. Thereafter, the bolts 128 are further screwed so as to secure the reinforcing pins 127 tightly. Finally, as shown in FIG. 3, the bolts 34 are tightened to secure the outer ring member 31 to the outer drive ring 32.

As shown in FIG. 8, a barrier seal 120, which is an annular flexible membrane, is disposed between the inner retaining ring 20 and the outer retaining ring 30. This barrier seal 120 extends over entire circumferences of the inner retaining ring 20 and the outer retaining ring 30 so as to seal the gap between the inner retaining ring 20 and the outer retaining ring 30. More specifically, the barrier seal 120 has its inner edge connected to the lower end of the inner driver ring 22 and has its outer edge connected to the lower end of the outer drive ring 32. The barrier seal 120 has an upwardly bent shape with an inverted U-shaped cross section. The barrier seal 120 is made of flexible material. For example, the barrier seal 120 may be made of a highly strong and durable rubber material, such as ethylene propylene rubber (EPDM), polyurethane rubber, silicone rubber, or the like.

The barrier seal 120 is located above the inner ring member 21 and the outer ring member 31 and below the stopper 119. The inner ring member 21 and the outer ring member 31 are kept out of contact with each other at all times, so that the inner retaining ring 20 and the outer retaining ring 30 do not contact each other below the barrier seal 120. Therefore, no wear debris is produced below the barrier seal 120. The barrier seal 120 can prevent particles, produced in the top ring body 10, from falling onto the polishing surface 2*a*, while allowing the inner retaining ring 20 and the outer retaining ring 30 to move relative to each other, and can also prevent the polishing liquid, i.e., slurry, from entering the top ring body 10 through the gap between the inner retaining ring 20 and the outer retaining ring 30.

A seal sheet 123, which is shaped so as to connect the top ring body 10 to the outer retaining ring 30, is mounted on a circumferential surface of the top ring 1. This seal sheet 123 is an annular flexible membrane extending over entire circumferences of the top ring body 10 and the outer retaining ring 30 so as to seal a gap between the top ring body 10 and the outer retaining ring 30. Specifically, the seal sheet 123 has its upper end connected to the lower end of the circumferential surface of the top ring body 10 and has its lower end connected to the outer circumferential surface of the outer retaining ring 30. The seal sheet 123 has a bellows shape so that it can be easily deformed in the vertical direction. As with the barrier seal 120, the seal sheet 123 is made of a highly strong and durable rubber material, such as ethylene propylene rubber (EPDM), polyurethane rubber, silicone rubber, or the like.

The seal sheet 123 can prevent particles, produced in the top ring body 10, from falling onto the polishing surface 2*a*, while allowing the outer retaining ring 30 to move relative to the top ring body 10 in the vertical direction, and can also prevent the polishing liquid, i.e., the slurry, from entering the top ring body 10 through the gap between the top ring body 10 and the outer retaining ring 30.

Typically, after the wafer is polished, the inner retaining ring 20 and the outer retaining ring 30 are cleaned with a cleaning liquid, such as ultrapure water or a chemical liquid. In order to introduce the cleaning liquid efficiently into the gap between the inner retaining ring 20 and the outer retaining ring 30, it is preferable to form a plurality of vertical grooves on the outer circumferential surface of the inner retaining ring 20 and/or the inner circumferential surface of the outer retaining ring 30.

Figure 12A:
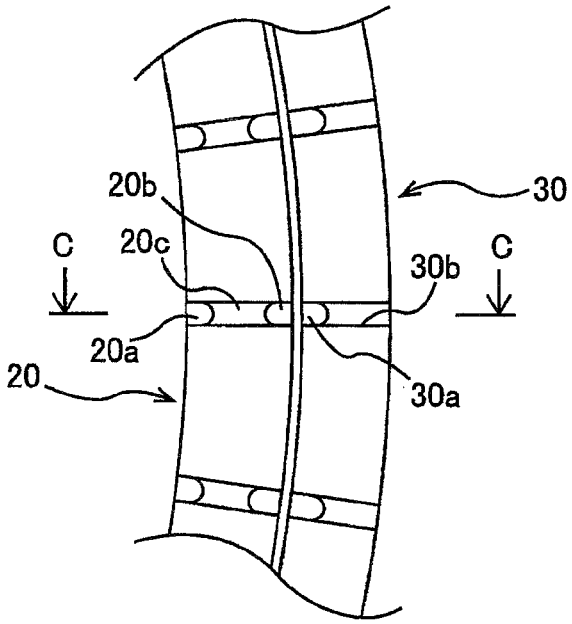
FIG. 12A is a bottom view of the inner retaining ring and the outer retaining ring.
Figure 12B:
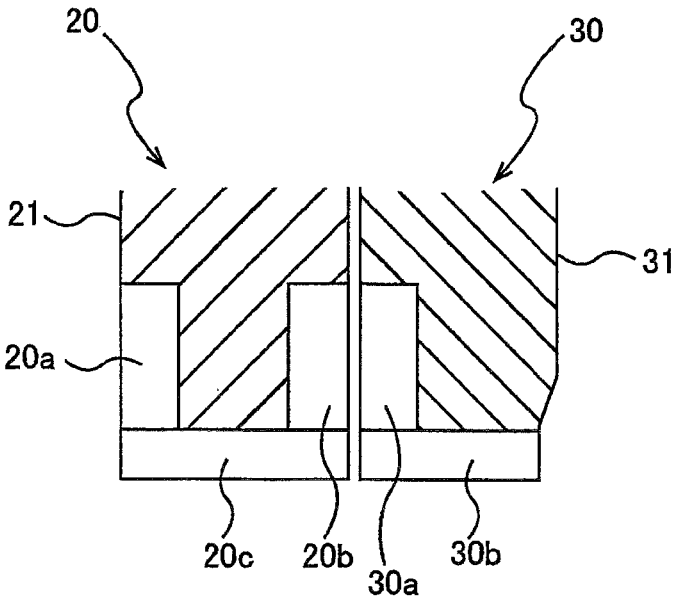
FIG. 12B is a cross-sectional view taken along line C-C in FIG. 12A.

FIG. 12A is a fragmentary bottom view of the inner retaining ring 20 and the outer retaining ring 30. FIG. 12B is a fragmentary cross-sectional view taken along line C-C in FIG. 12A. The inner ring member 21 has: a plurality of vertical grooves 20*a* formed on the inner circumferential surface thereof; and a plurality of vertical grooves 20*b* formed on the outer circumferential surface thereof. The inner ring member 21 further has a plurality of radially-extending radial grooves 20*c* formed on the lower surface thereof. The vertical grooves 20*a* and 20*b* extend upwardly from the lower surface of the inner retaining ring 20 (i.e., the lower surface of the inner ring member 21) to a position higher than the radial grooves 20*c*. The vertical grooves 20*a* and 20*b* and the radial grooves 20*c* are arranged at equal intervals along the circumferential direction of the inner retaining ring 20. The radial grooves 20*c* extend radially through the inner retaining ring 20, while the vertical grooves 20*a* and 20*b* do not extend through the inner retaining ring 20. The vertical grooves 20*a* and 20*b* are arranged at the same positions as the radial grooves 20*c* with respect to the circumferential direction of the inner retaining ring 20, so that the vertical grooves 20*a* and 20*b* are in fluid communication with the radial grooves 20*c*. While the vertical grooves 20*a* and 20*b* have the same width as the radial grooves 20*e* in this embodiment, the vertical grooves 20*a* and 20*b* may be narrower or wider than the radial grooves 20*c*.

Similarly, the outer ring member 31 has: a plurality of vertical grooves 30*a* formed on the inner circumferential surface thereof; and a plurality of radially-extending radial grooves 30*b* formed on the lower surface thereof. The vertical grooves 30*a* extend upwardly from the lower surface of the outer retaining ring 30 (i.e., the lower surface of the outer ring member 31) to a position higher than the radial grooves 30*b*. The vertical grooves 30*a* and the radial grooves 30*b* are arranged at equal intervals along the circumferential direction of the outer retaining ring 30. The radial grooves 30*b* extend radially through the outer retaining ring 30, while the vertical grooves 30*a* do not extend through the outer retaining ring 30. The vertical grooves 30*a* are arranged at the same position as the radial grooves 30*b* with respect to the circumferential direction of the outer retaining ring 30, so that the vertical grooves 30*a* are in fluid communication with the radial grooves 30*b*. While the vertical grooves 30*a* have the same width as the radial grooves 30*b* in this embodiment, the vertical grooves 30*a* may be narrower or wider than the radial grooves 30*b*. The vertical grooves 20*a*, 20*b*, and 30*a* are located below the barrier seal 120.

The cleaning liquid, supplied to the lower surfaces of the inner retaining ring 20 and the outer retaining ring 30, flows through the vertical grooves 20*b* and 30*a* into the gap between the inner retaining ring 20 and the outer retaining ring 30, washing away the polishing liquid from this gap. The cleaning liquid is also introduced through the vertical groove 20*a* into a gap between the inner retaining ring 20 and the flexible membrane 45, washing away the polishing liquid from this gap. Therefore, the inner retaining ring 20 and the outer retaining ring 30 can maintain their smooth motions.

When the wafer is being polished, the polishing liquid is supplied onto the polishing surface 2*a* of the polishing pad 2. The wafer is polished by the sliding contact with the polishing surface 2*a* of the polishing pad 2 in the presence of the polishing liquid between the wafer and the polishing pad 2. The radial grooves 20*c* and 30*b* are provided on the respective lower surfaces of the inner retaining ring 20 and the outer retaining ring 30 for the purpose of accelerating the flow of the polishing liquid into a space between the wafer and the polishing pad 2 and accelerating the flow of the used polishing liquid, which no longer exhibits its polishing action, out of the space between the wafer and the polishing pad 2. Cross-sectional shapes and numbers of radial grooves 20*c* and 30*b* are selected appropriately according to the purposes of providing the radial grooves.

Figure 13A:
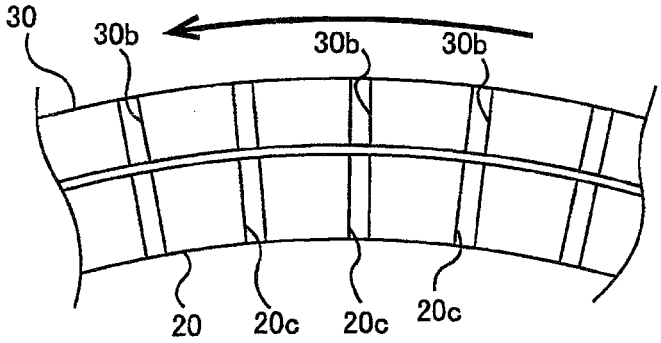
FIG. 13A is a view showing an example of radial grooves formed on respective lower surfaces of the inner retaining ring and the outer retaining ring.
Figure 13B:
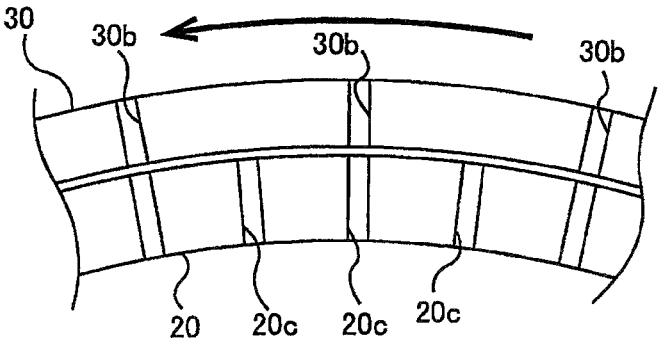
FIG. 13B is a view showing another example of the radial grooves.
Figure 13C:
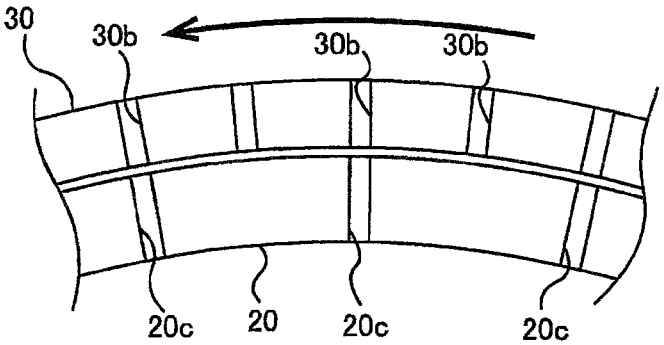
FIG. 13C is a view showing still another example of the radial grooves.

FIGS. 13A through 13C are fragmentary views showing examples of the radial grooves 20*c* and 30*b* formed on the respective lower surfaces of the inner retaining ring 20 and the outer retaining ring 30. In these examples, the radial grooves 20*c* and 30*b* extend in the radial directions of the inner retaining ring 20 and the outer retaining ring 30. FIG. 13A shows an example in which the number of radial grooves 30*b* is the same as the number of radial grooves 20*c*. FIG. 13B shows an example in which the number of radial grooves 30*b* is smaller than the number of radial grooves 20*c*. FIG. 13C shows an example in which the number of radial grooves 20*c* is smaller than the number of radial grooves 30*b*. In order to effectively accelerate the flow of the polishing liquid into and out of the retaining rings 20 and 30, it is preferable that the radial grooves 20*c* and 30*b* be arranged at the same circumferential positions.

Figure 14A:
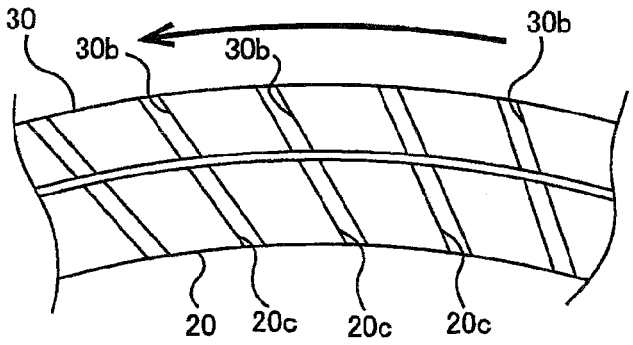
FIG. 14A is a view showing still another example of the radial grooves.
Figure 14B:
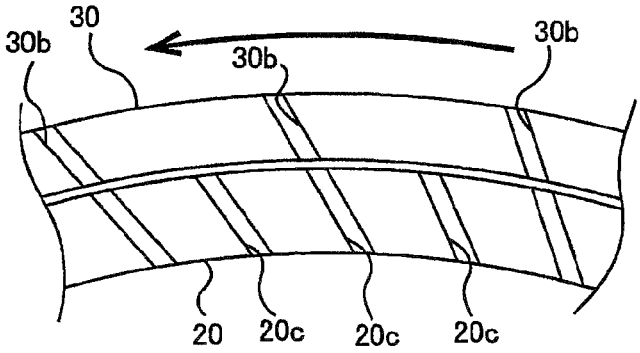
FIG. 14B is a view showing still another example of the radial grooves.
Figure 14C:
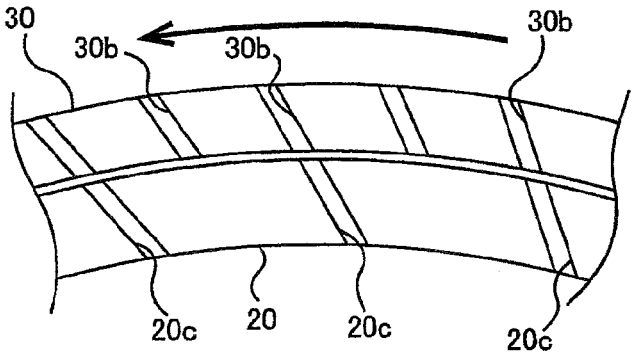
FIG. 14C is a view showing still another example of the radial grooves.

FIGS. 14A through 14C are fragmentary views showing other examples of the radial grooves 20*c*, 30*b* formed on the respective lower surfaces of the inner retaining ring 20 and the outer retaining ring 30. FIG. 14A shows an example in which the number of radial grooves 30*b* is the same as the number of radial grooves 20*c*. FIG. 14B shows an example in which the number of radial grooves 30*b* is smaller than the number of radial grooves 20*c*. FIG. 14C shows an example in which the number of radial grooves 20*c* is smaller than the number of radial grooves 30*b*. In these examples, the radial grooves 20*c* and 30*b* are inclined from the radial directions of the inner retaining ring 20 and the outer retaining ring 30. More specifically, the radial grooves 20*c* and 30*b* are inclined forwardly with respect to the rotating direction (indicated by the arrow) of the inner retaining ring 20 and the outer retaining ring 30 so that, as the inner retaining ring 20 and the outer retaining ring 30 rotate, the polishing liquid flows from the outside to the inside of the inner retaining ring 20 and the outer retaining ring 30.

Figure 15A:
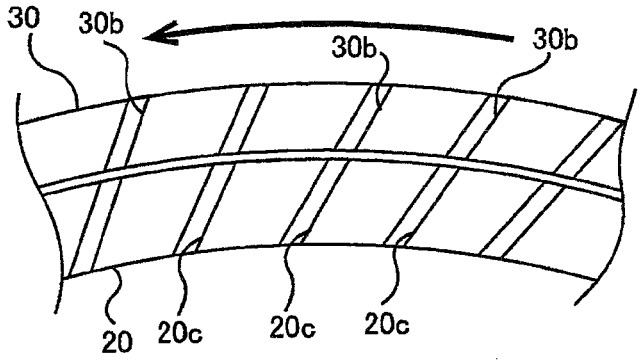
FIG. 15A is a view showing still another example of the radial grooves.
Figure 15B:
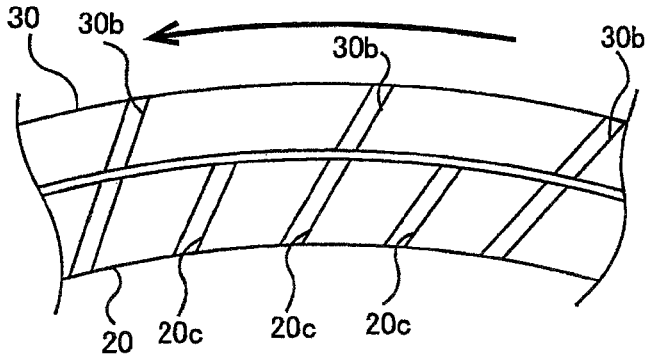
FIG. 15B is a view showing still another example of the radial grooves.
Figure 15C:
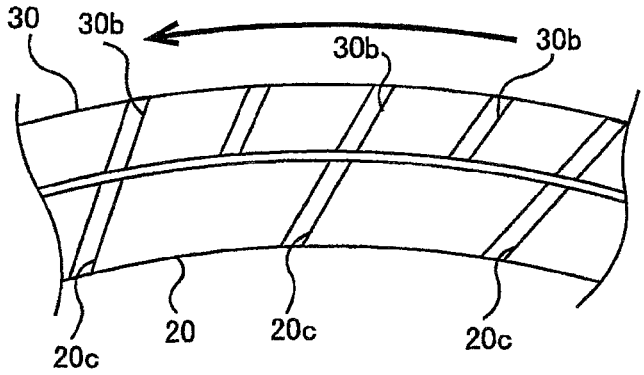
FIG. 15C is a view showing still another example of the radial grooves.

FIGS. 15A through 15C are fragmentary views showing still other examples of the radial grooves 20*c* and 30*b* formed on the respective lower surfaces of the inner retaining ring 20 and the outer retaining ring 30. FIG. 15A shows an example in which the number of radial grooves 30*b* is the same as the number of radial grooves 20*c*. FIG. 15B shows an example in which the number of radial grooves 30*b* is smaller than the number of radial grooves 20*c*. FIG. 15C shows an example in which the number of radial grooves 20*c* is smaller than the number of radial grooves 30*b*. These examples are the same as the above examples in that the radial grooves 20*c* and 30*b* are inclined from the radial directions of the inner retaining ring 20 and the outer retaining ring 30, but are different in that the radial grooves 20*c* and 30*b* are inclined in a direction opposite to the direction as shown in FIGS. 14A through 14C. Specifically, the radial grooves 20*c* and 30*b* are inclined backwardly with respect to the rotating direction (indicated by the arrow) of the inner retaining ring 20 and the outer retaining ring 30 so that, as the inner retaining ring 20 and the outer retaining ring 30 rotate, the polishing liquid flows from the inside to the outside of the inner retaining ring 20 and the outer retaining ring 30.

The cross-sectional shapes, the widths, and the numbers of radial grooves 20*c* of the inner retaining ring 20 may be different from or the same as those of the radial grooves 30*b* of the outer retaining ring 30. The radial grooves 20*c* and 30*b* are deep enough to contribute to the flowing-in and flowing-out actions of the polishing liquid even when the inner retaining ring 20 and the outer retaining ring 30 are worn down.

Figure 16:
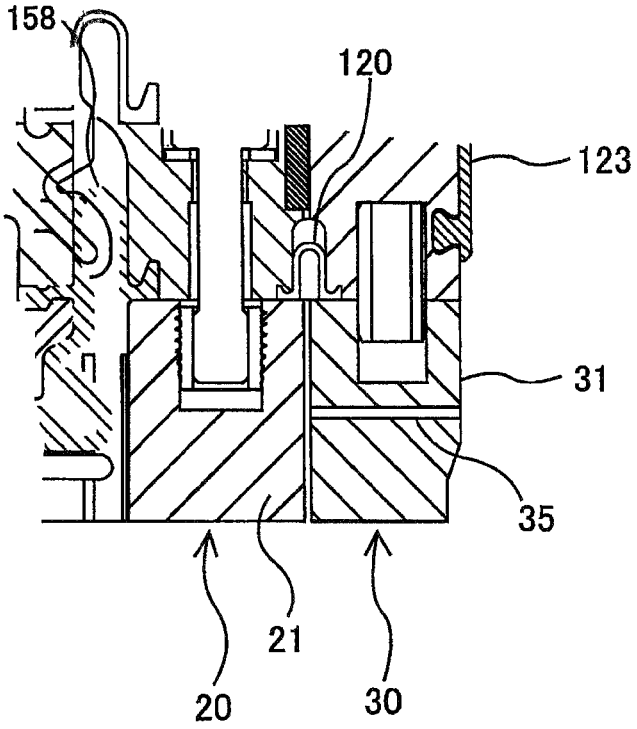
FIG. 16 is a cross-sectional view of the outer retaining ring having through-holes formed therein.

Although FIGS. 13A through 15C show the examples of the outer retaining ring 30 having the radial grooves 30*b*, it is preferable that the outer retaining ring 30 does not have the radial grooves if the polishing liquid should not flow into and out of the outer retaining ring 30. In the case of using the outer retaining ring 30 with no radial groove, it is preferable to provide a plurality of through-holes 35 extending from the inner circumferential surface to the outer circumferential surface of the outer retaining ring 30, as shown in FIG. 16. These through-holes 35 extend radially through the outer retaining ring 30 and are arranged along the entire circumference of the outer retaining ring 30. The through-holes 35 enable the inner retaining ring 20 and the outer retaining ring 30 to move smoothly in the vertical direction. The through-holes 35 are preferably located below the barrier seal 120 and the seal sheet 123. This is because of preventing the polishing liquid from entering regions surrounded by the barrier seal 120 and the seal sheet 123 and further preventing particles, which are produced in the surrounded regions, from falling onto the polishing surface 2*a*.

Structural details of the top ring 1 will be further described below. As shown in FIG. 3, the edge holder 50 is held by the ripple holder 51. The ripple holder 51 is mounted on a lower portion of the carrier 43 by a plurality of stoppers 54. As shown in FIGS. 4 and 6, a ripple holder 52 is mounted on the lower portion of the carrier 43 by a plurality of stoppers 55. The stoppers 54 and the stoppers 55 are arranged at equal intervals along the circumferential direction of the top ring 1.

As shown in FIG. 3, a central chamber 130 is formed on a central portion of the flexible membrane 45. The ripple holder 52 has a fluid passage 140 formed therein which is in fluid communication with the central chamber 130. The carrier 43 has a fluid passage 141 formed therein which is in fluid communication with the fluid passage 140. This fluid passage 141 is coupled to a fluid supply source (not shown), so that a pressurized fluid (e.g., pressurized air) is supplied from the fluid supply source into the central chamber 130 through the fluid passage 141 and the fluid passage 140.

The ripple holder 51 has a claw portion 51*a* that presses a ripple 45*b* of the flexible membrane 45 against the lower portion of the carrier 43. The ripple holder 52 has a claw portion 52*a* that presses a ripple 45*a* of the flexible membrane 45 against the lower portion of the carrier 43. The flexible membrane 45 has an edge 45*c*, which is pressed against the edge holder 50 by a claw portion 51*b* of the ripple holder 51.

As shown in FIG. 2, an annular ripple chamber 131 is formed between the ripple 45*a* and the ripple 45*b* of the flexible membrane 45. The flexible membrane 45 has a gap 45*f* formed between the ripple holder 51 and the ripple holder 52. The carrier 43 has a fluid passage 142 formed therein which is in fluid communication with the gap 45*f* and the ripple chamber 131. This fluid passage 142 is coupled to the fluid supply source (not shown), so that the pressurized fluid is supplied into the ripple chamber 131 through the fluid passage 142. The fluid passage 142 is also selectively coupled to a vacuum pump (not shown), so that the wafer is attracted to the lower surface of the flexible membrane 45 by the operation of the vacuum pump.

The ripple holder 51 has a fluid passage (not shown) formed therein which is in fluid communication with an annular outer chamber 132, which is formed by the ripple 45*b* and the edge 45*c* of the flexible membrane 45. This fluid passage formed in the ripple holder 51 is coupled to the fluid supply source (not shown), so that the pressurized fluid is supplied into the outer chamber 132.

As shown in FIGS. 4 and 8, the edge holder 50 is configured to press an edge 45*d* of the flexible membrane 45 against the lower portion of the carrier 43 to secure the edge 45*d* to the carrier 43. The edge holder 50 has a fluid passage 143 formed therein which is in fluid communication with an annular edge chamber 133 formed by the edge 45*c* and the edge 45*d* of the flexible membrane 45. The fluid passage 143 is coupled to the fluid supply source (not shown), so that the pressurized fluid is supplied into the edge chamber 133 through the fluid passage 143.

In this embodiment of the top ring 1, pressing forces of pressing the wafer against the polishing pad 2 can be controlled in multiple zones of the wafer by regulating pressures of the fluid supplied to the pressure chambers defined between the flexible membrane 45 and the carrier 43 of the top ring body 10, i.e., the central chamber 130, the ripple chamber 131, the outer chamber 132, and the edge chamber 133.

The rolling diaphragm 62 (see FIG. 8) used in the inner pressing mechanism 60 is formed from a flexible membrane having a bent portion. When the internal pressure of the pressure chamber 69 formed by the rolling diaphragm 62 increases, the bent portion of the rolling diaphragm 62 rolls so as to expand the pressure chamber 69. When the pressure chamber 69 is expanded, the rolling diaphragm 62 is not brought into sliding contact with the inner cylinder 63, and the rolling diaphragm 62 itself does not substantially expand. Therefore, sliding friction hardly occurs. Consequently, the rolling diaphragm 62 can have a longer service life, and the pressing force applied from the inner retaining ring 20 to the polishing pad 2 can be controlled precisely. In addition, even when the inner ring member 21 of the inner retaining ring 20 is worn, the pressing force of the inner retaining ring 20 can be maintained at a constant level. The rolling diaphragm 82 of the outer pressing mechanism 80 has the same structures and offers the same advantages as those of the rolling diaphragm 62 of the inner pressing mechanism 60.

As shown in FIG. 6, the coupling member 100 that couples the outer drive ring 32 to the spherical bearing 111 has the eight spokes 102 extending radially outwardly. These spokes 102 are housed respectively in radially extending eight slots 43*g* that are formed on an upper surface of the carrier 43. Multiple pairs of outer ring drive collars 150 and 150 are provided on the carrier 43. Each pair of the outer ring drive collars 150 and 150 are disposed on both sides of each spoke 102. In the example shown in FIG. 6, four pairs of outer ring drive collars 150 and 150 are provided for four of the eight spokes 102.

The top ring body 10 is coupled to the top ring shaft 7, so that the top ring body 10 is rotated by the top ring shaft 7. The rotation of the top ring body 10 is transmitted from the carrier 43 to the spokes 102 through the multiple pairs of the outer ring drive collars 150 and 150 to thereby rotate the outer retaining ring 30 in unison with the top ring body 10. The outer ring drive collars 150 are made of a low-friction material, such as PTFE, PEEK, PPS, or the like. Both side surfaces of each spoke 102, which contact the outer ring drive collars 150, are mirror-finish surfaces with reduced surface roughness. Alternatively, the outer ring drive collars 150 may have mirror-finish surfaces, while the side surfaces of each spoke 102 may be covered (e.g., coated) with a low-friction material.

These structures can enable the outer ring drive collars 150 and the spokes 102 to slide more smoothly. Therefore, the outer retaining ring 30 can tilt smoothly. A torque transmission structure for transmitting the rotation of the top ring body 10 to the outer retaining ring 30 is constituted by the outer ring drive collars 150 and the spokes 102. This torque transmission structure is disposed in the top ring body 10. Therefore, wear debris that has been produced from the torque transmission structure is confined in the top ring body 10 and does not fall onto the polishing surface 2*a*. Consequently, wafer defects, such as scratches, caused by the wear debris are greatly reduced.

As shown in FIG. 7, the inner retaining ring 20 has a plurality of recesses 20*d* formed on the outer circumferential surface thereof. Inner ring drive pins 152, which are mounted on the outer retaining ring 30, are housed in these recesses 20*d*, respectively. Cylindrical inner ring drive collars 153 are mounted on outer circumferential surfaces of the inner ring drive pins 152, respectively. In FIG. 7, horizontal cross sections of the inner ring drive collars 153 are depicted. The inner ring drive collars 153 are made of a low-friction material, such as PTFE, PEEK, PPS, or the like. Each recess 20*d* has opposed side surfaces extending vertically. When the outer retaining ring 30 rotates, the inner ring drive collar 153 is brought into contact with one of the side surfaces of the recess 20*d*. The rotation of the outer retaining ring 30 is transmitted to the inner retaining ring 20 through the inner ring drive pins 152, so that the inner retaining ring 20 rotates in unison with the outer retaining ring 30. The side surfaces of the recess 20*d*, which contact the inner ring drive collar 153, are mirror-finish surfaces with reduced surface roughness.

These structures can enable the inner ring drive collars 153 and the recesses 20*d* to slide more smoothly. Therefore, the outer retaining ring 30 can tilt smoothly. Moreover, the inner retaining ring 20 can exert a desired pressing force uniformly on the polishing surface 2*a* without being affected by the tilting movement of the outer retaining ring 30. While the inner retaining ring 20 has the recesses 20*d* and the outer retaining ring 30 has the inner ring drive pins 152 in this embodiment, the inner retaining ring 20 may have inner ring drive pins and the outer retaining ring 30 may have recesses. Rubber cushions may be disposed between the inner ring drive pins 152 and the inner ring drive collars 153.

As shown in FIGS. 4 and 7, a plurality of stopper pins 155, which project radially inwardly, are fixed to the inner retaining ring 20. These stopper pins 155 are in loose engagement with a plurality of respective vertically extending recesses 43*h* formed on the carrier 43 of the top ring body 10. The recesses 43*h* are arranged at equal intervals on the circumferential surface of the carrier 43. Each stopper pin 155 is vertically movable between an upper end and a lower end of each recess 43*h*. In other words, the vertical movement of the inner retaining ring 20 relative to the top ring body 10 is restricted by the stopper pins 155 and the recesses 43*h*. When the stopper pins 155 are brought into contact with the upper ends of the recesses 43*h*, the inner retaining ring 20 is in an uppermost position relative to the top ring body 10. When the stopper pins 155 are brought into contact with the lower ends of the recesses 43*h*, the inner retaining ring 20 is in a lowermost position relative to the top ring body 10. The stopper pins 155 and the recesses 43*h* can prevent the inner retaining ring 20 from falling off the top ring body 10.

As shown in FIG. 4, each inner ring drive collar 153 is vertically movable between an upper end and a lower end of each recess 20*d* formed on the inner retaining ring 20. In other words, the vertical movement of the outer retaining ring 30 relative to the inner retaining ring 20 is restricted by the inner ring drive collars 153 and the recesses 20*d*. When the inner ring drive collars 153 are brought into contact with the upper ends of the recesses 20*d*, the outer retaining ring 30 is in an uppermost position relative to the inner retaining ring 20. When the inner ring drive collars 153 are brought into contact with the lower ends of the recesses 20*d*, the outer retaining ring 30 is in a lowermost position relative to the inner retaining ring 20.

The inner piston 61 and the inner retaining ring 20 are magnetically secured to each other. Therefore, even if the inner retaining ring 20 vibrates when the wafer W is being polished, the inner piston 61 and the inner retaining ring 20 are not separated from each other, and the inner retaining ring 20 is prevented from rising abruptly due to the vibrations. Therefore, the inner retaining ring 20 can apply a stable pressing force, and can in turn reduce the possibility that the wafer is separated from (or slips off) the top ring 1. Moreover, the inner retaining ring 20, which requires frequent maintenance, can be easily separated from the inner piston 61 which requires less maintenance. The outer piston 81 and the outer retaining ring 30 are also magnetically secured to each other, and hence offer the same advantages as those of the inner piston 61 and the inner retaining ring 20.

As shown in FIG. 4, when the maintenance bolts 16 are removed, the carrier 43 holding the flexible membrane 45, together with the inner retaining ring 20 and the outer retaining ring 30, is separated from the spacer 42. Since the inner retaining ring 20, the outer retaining ring 30, and the carrier 43 can be separated from the top ring 1 in this manner, it is possible to easily conduct the maintenance of the inner retaining ring 20 and the outer retaining ring 30 and the maintenance of the flexible membrane 45. As shown in FIG. 6, recesses 22*a* and 32*a* are formed on an upper surface of the inner drive ring 22 and an upper surface of the outer drive ring 32, respectively. When conducting the maintenance of the outer retaining ring 30, a thin plate or the like may be inserted into the recess 32*a* from its outer side so as to reduce the magnetic force acting between the outer retaining ring 30 and the outer piston 81, so that the outer retaining ring 30 can be easily separated from the outer piston 81. The inner retaining ring 20 and the inner piston 61 can also be easily separated from each other by inserting a thin plate or the like into the recess 22*a*.

As shown in FIG. 8, a seal member 158 having an upwardly bent shape is connected to the edge (i.e., peripheral edge) 45*d* of the flexible membrane 45. This seal member 158 extends so as to connect the flexible membrane 45 to the inner retaining ring 20. The seal member 158 is arranged so as to seal the gap between the top ring body 10 and the inner drive ring 22 and is made of flexible material. The seal member 158 can prevent particles, produced in the top ring 1, from falling onto the polishing surface 2*a*, while allowing the top ring body 10 and the inner retaining ring 20 to move relative to each other, and can also prevent the polishing liquid, i.e., slurry, from entering the top ring 1 through the gap between the top ring body 10 and the inner retaining ring 20. In this embodiment, the seal member 158 is integral with the edge 45*d* of the flexible membrane 45 and has an inverted U-shaped cross section.

If the seal sheet 123, the seal member 158, and the barrier seal 120 are not provided, the polishing liquid enters the top ring 1, thus preventing normal operations of the top ring body 10, the inner retaining ring 20, and the outer retaining ring 30 of the top ring 1. According to the present embodiment, the seal sheet 123, the seal member 158, and the barrier seal 120 can prevent the polishing liquid from entering the top ring 1, so that the top ring 1 can operate properly. The flexible membrane 45, the seal sheet 123, the seal member 158, and the barrier seal 120 are made of a highly strong and durable rubber material, such as ethylene propylene rubber (EPDM), polyurethane rubber, silicone rubber, or the like.

The top ring 1 according to the present embodiment is configured to control the pressing forces applied to the wafer by the fluid pressures supplied to the central chamber 130, the ripple chamber 131, the outer chamber 132, and the edge chamber 133 of the flexible membrane 45. Accordingly, during polishing of the wafer, the carrier 43 should be in an upward position away from the polishing pad 2. Since the inner retaining ring 20 and the outer retaining ring 30 are vertically movable independently of the top ring body 10, even when the inner retaining ring 20 and the outer retaining ring 30 are worn, the distance between the wafer and the top ring body 10 during polishing of the wafer can be kept constant. Therefore, a stable polishing profile of the wafer can be ensured.

Figure 17:
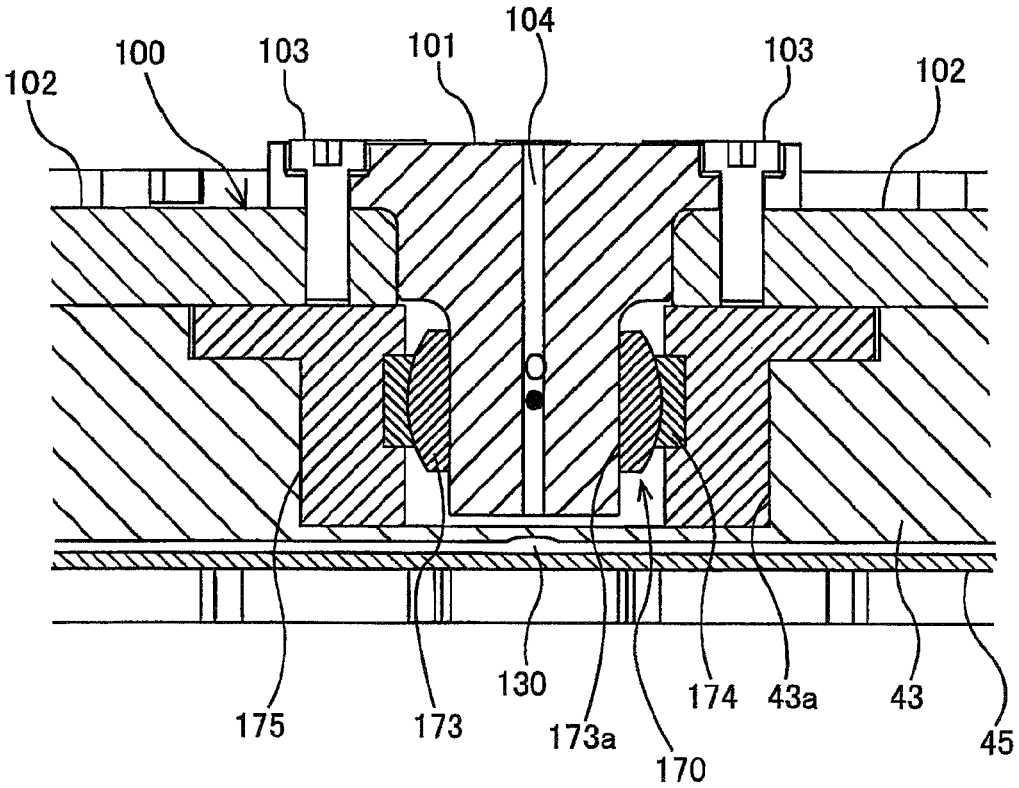
FIG. 17 is a cross-sectional view showing another example of the spherical bearing.

FIG. 17 shows is an enlarged cross-sectional view of another example of the spherical bearing. Components shown in FIG. 17 identical to those shown in FIG. 9 are denoted by the same reference numerals. The spherical bearing 170 shown in FIG. 17 includes: an annular inner bearing ring 173; and an annular outer bearing ring 174 which slidably supports an outer circumferential surface of the inner bearing ring 173. The inner bearing ring 173 is coupled to the outer retaining ring 30 through the coupling member 100. The outer bearing ring 174 is secured to a support member 175, which is secured to the carrier 43. The support member 175 is disposed in the recess 43*a* which is formed on the central portion of the carrier 43.

The outer circumferential surface of the inner bearing ring 173 has a spherical shape whose upper and lower portions are cut off. A central point (fulcrum) O' of this spherical shape is located at the center of the inner bearing ring 173. The outer bearing ring 174 has an inner circumferential surface which is a concave surface shaped so as to fit the outer circumferential surface of the inner bearing ring 173, so that the outer bearing ring 174 slidably supports the inner bearing ring 173. The inner bearing ring 173 is tiltable in all directions through 360° with respect to the outer bearing ring 174.

The inner bearing ring 173 has an inner circumferential surface which forms a through-hole 173*a* in which the shaft portion 101 is inserted. The shaft portion 101 is movable relative to the inner bearing ring 173 only in the vertical direction. Therefore, the outer retaining ring 30, which is coupled to the shaft portion 101, is substantially not allowed to move laterally, i.e., horizontally. That is, the outer retaining ring 30 is fixed in its lateral position (i.e., its horizontal position) by the spherical bearing 170.

Figure 18A:
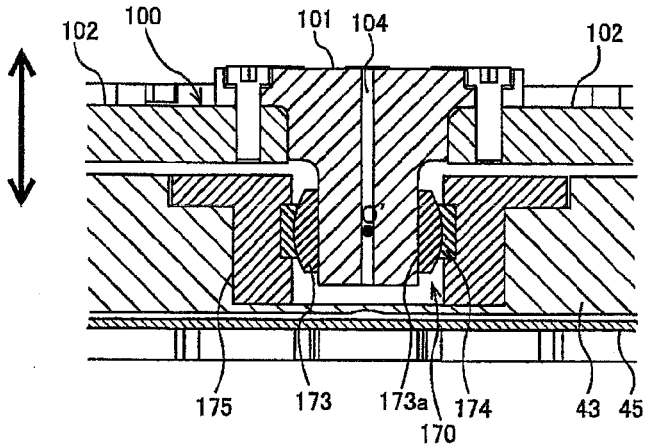
FIG. 18A is a cross-sectional view showing the manner in which the shaft portion is vertically moved relative to the spherical bearing.
Figure 18B:
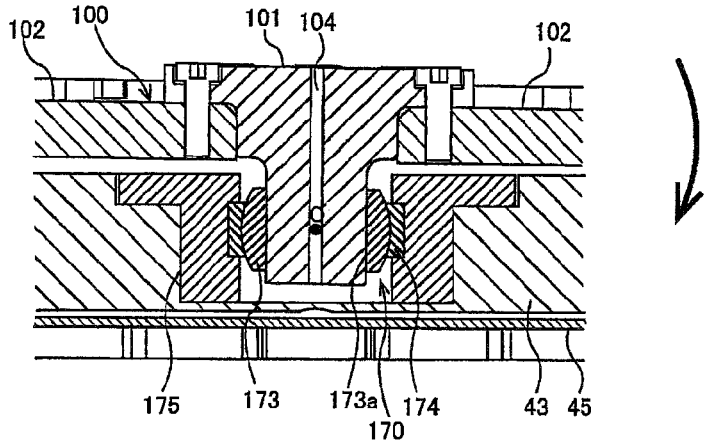
FIG. 18B is a cross-sectional view showing the manner in which the shaft portion tilts in unison with an inner bearing ring.
Figure 18C:
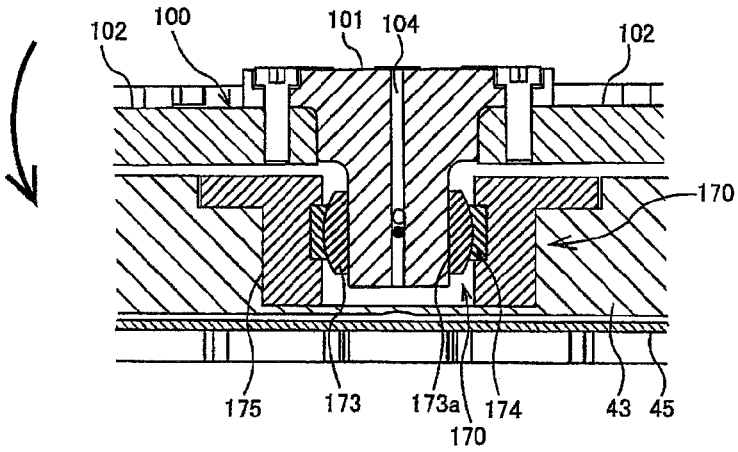
FIG. 18C is a cross-sectional view showing the manner in which the shaft portion tilts in unison with the inner bearing ring.

FIG. 18A shows the manner in which the shaft portion 101 is vertically moved relative to the spherical bearing 170. FIGS. 18B and 18C show the manner in which the shaft portion 101 tilts in unison with the inner bearing ring 173. The shaft portion 101 and the outer retaining ring 30 (not shown in FIGS. 18A through 18C) coupled thereto are tiltable around the fulcrum O' in unison with the inner bearing ring 173 and are vertically movable relative to the inner bearing ring 173.

The spherical bearing 170 shown in FIG. 17 has the same functions as those of the spherical bearing 111 shown in FIG. 9. However, the fulcrum O' as the center of the tilting movement of the spherical bearing 170 is higher in position than the fulcrum O of the spherical bearing 111. More specifically, the fulcrum O' is located within the spherical bearing 170. The spherical bearing 170 thus constructed still allows the outer retaining ring 30 to tilt smoothly and positively when the frictional force produced between the wafer and the polishing pad 2 is indirectly applied to the outer retaining ring 30 through the inner retaining ring 20.

Figure 19:
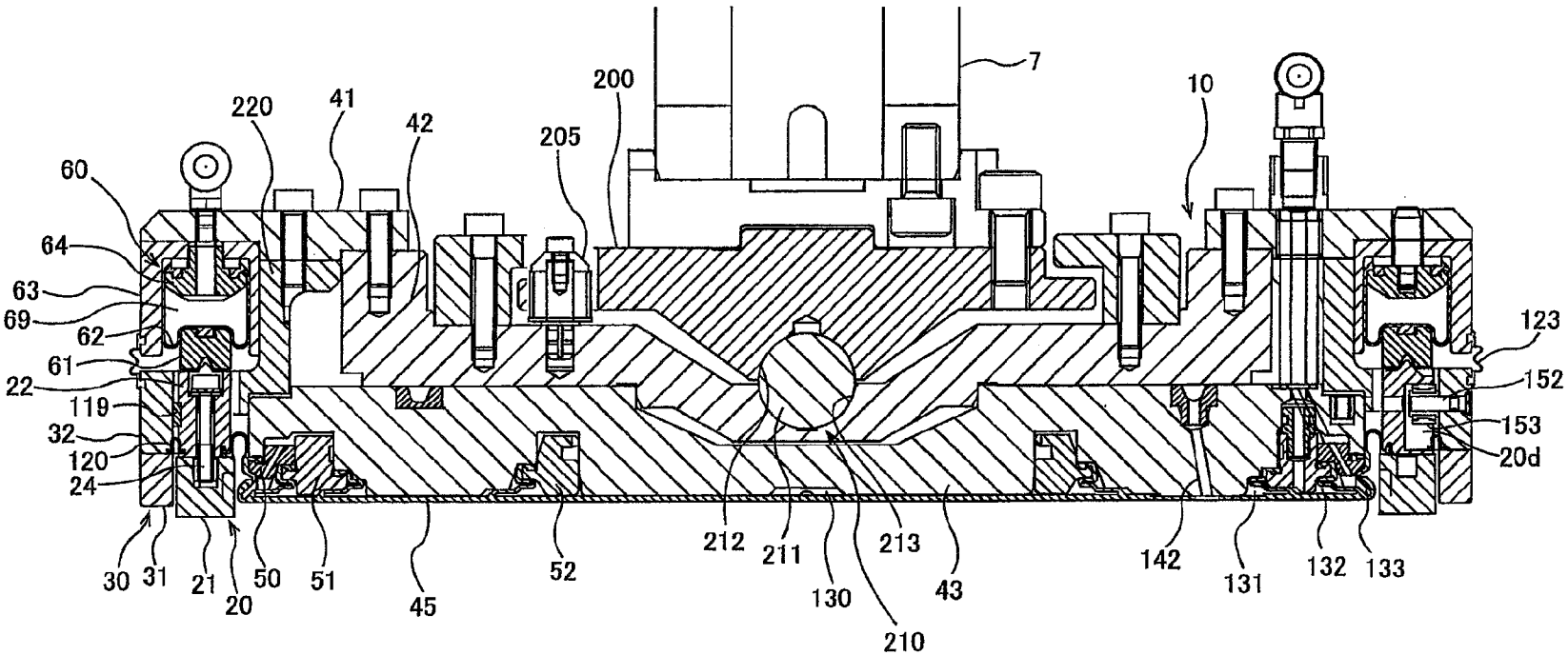
FIG. 19 is a cross-sectional view of another embodiment of the substrate holder (top ring) according to the present invention.
Figure 20:
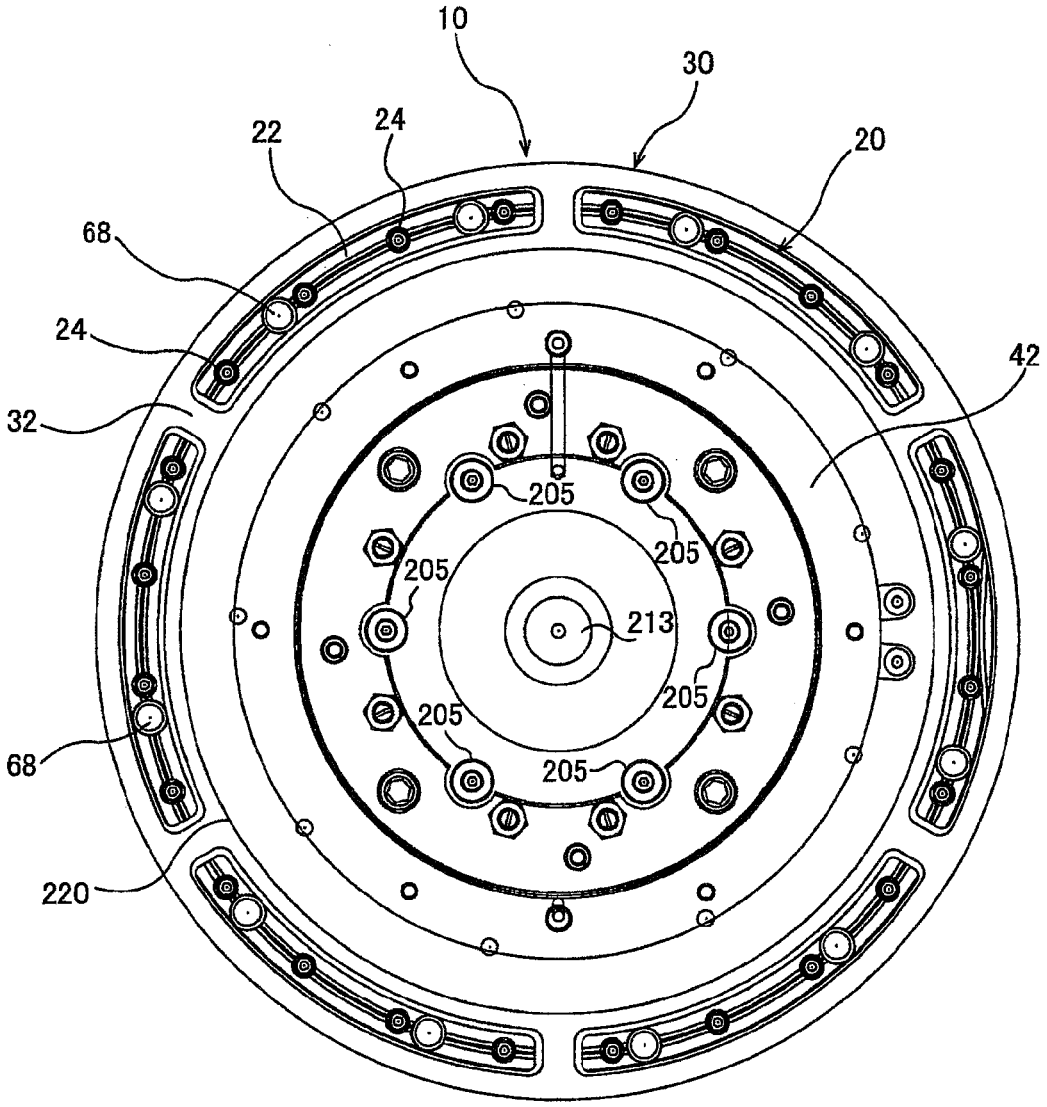
FIG. 20 is a plan view of a top ring body, the inner retaining ring, and the outer retaining ring shown in FIG. 19.
Figure 21:
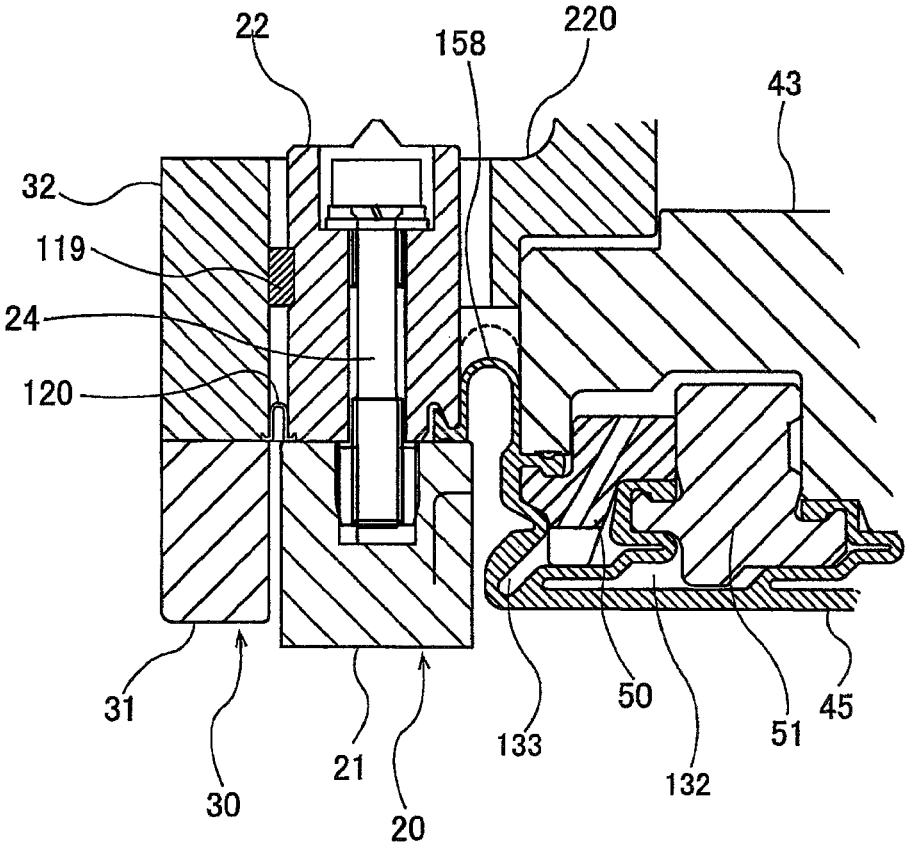
FIG. 21 is an enlarged fragmentary cross-sectional view of the top ring shown in FIG. 19.

FIG. 19 is a cross-sectional view of another embodiment of the substrate holder (top ring) according to the present invention. FIG. 20 is a plan view of the top ring body, the inner retaining ring, and the outer retaining ring shown in FIG. 19. FIG. 21 is an enlarged fragmentary cross-sectional view of the top ring shown in FIG. 19. Those parts shown in FIGS. 19 through 21 which are identical to or correspond to those shown in FIGS. 2 through 8 are denoted by identical reference numerals, and will not be described in duplication.

The top ring 1 has a drive flange (load transfer member) 200 disposed above the spacer 42. This drive flange 200 is fixed to the lower end of the top ring shaft 7 and is rotatable in unison with the top ring shaft 7. The rotation of the drive flange 200 is transmitted to the spacer 42 through a plurality of torque transmission pins 205 fixed to the upper surface of the spacer 42.

A spherical bearing 210 is interposed between the drive flange 200 and the spacer 42. This spherical bearing 210 includes: a hard ball 211 made of ceramic or the like; an upper hemispheric support surface 212 that slidably supports the ball 211 from above; and a lower hemispheric support surface 213 that slidably supports the ball 211 from below. The upper hemispheric support surface 212 is formed on a lower surface of the drive flange 200. Therefore, the drive flange 200 serves as a part of the spherical bearing 210. The lower hemispheric support surface 213 is formed on the upper surface of the spacer 42. Therefore, the spacer 42 serves as a part of the spherical bearing 210.

The drive flange 200 and the torque transmission pins 205 are not fixed to each other. A circumferential portion of the drive flange 200 is simply in contact with circumferential surfaces of the torque transmission pins 205. Therefore, the top ring body 10, which includes the flange 41, the spacer 42, and the carrier 43, can tilt in all directions through 360° with respect to the drive flange 200 by the spherical bearing 210. The center of the tilting movement of the spherical bearing 210 lies at the center of the ball 211 and on the central axis of the outer retaining ring 30. The drive flange 200, the flange 41, and the spacer 42 should desirably be made of a relatively highly rigid material, such as metal (e.g., stainless steel, aluminum, or the like) or ceramic.

A downward load and a torque of the top ring shaft 7 are transmitted to the top ring body 10 through the drive flange 200. Specifically, the downward load of the top ring shaft 7 is transferred to the top ring body 10 through the drive flange 200 and the spherical bearing 210. The torque of the top ring shaft 7 is transmitted to the top ring body 10 through the drive flange 200 and the torque transmission pins 205.

The top ring 1 of the embodiment includes the inner pressing mechanism 60, but does not include the outer pressing mechanism 80 (see FIGS. 2 through 5). The outer retaining ring 30 is rigidly fixed to the top ring body 10. Therefore, the outer retaining ring 30 is tiltable, rotatable, and vertically movable in unison with the top ring body 10. The outer drive ring 32 is fixed to the flange 41 through a connecting member 220, and the outer ring member 31 is fixed to the lower end of the outer drive ring 32. The outer drive ring 32 and the connecting member 220 are integrally formed.

The inner ring drive pins 152 are fixed to the outer retaining ring 30 and project radially inwardly from the outer retaining ring 30. The inner ring drive collars 153 are rotatably mounted on the respective inner ring drive pins 152. The inner drive ring 22 has the recesses 20*d* formed on the outer circumferential surface thereof. The inner ring drive collars 153 are housed in the recesses 20*d*, respectively, such that the inner ring drive collars 153 are vertically movable in the recesses 20*d*. The rotation of the outer retaining ring 30 is transmitted to the inner retaining ring 20 through the inner ring drive pins 152 and the inner ring drive collars 153, thus rotating the inner retaining ring 20 in unison with the outer retaining ring 30 and the top ring body 10.

While the outer retaining ring 30 is vertically movable in unison with the top ring body 10, the inner retaining ring 20 is vertically movable independently relative to the outer retaining ring 30 and the top ring body 10. The drive flange 200 secured to the top ring shaft 7 transmits the downward load to the top ring body 10 and the outer retaining ring 30. The top ring shaft 7 is configured to be elevated and lowered by an air cylinder (not shown). The downward load transmitted to the top ring body 10 and the outer retaining ring 30 through the drive flange 200 is regulated by the air cylinder.

When the wafer is polished, the pressurized fluid is supplied to the pressure chambers formed between the flexible membrane 45 and the top ring body 10, i.e., the central chamber 130, the ripple chamber 131, the outer chamber 132, and the edge chamber 133. The pressurized fluid is supplied to the inner pressure chamber 69 of the inner pressing mechanism 60 as well. Therefore, the top ring body 10 receives an upward reaction force from these pressure chambers. The load applied to the polishing pad 2 from the outer retaining ring 30 is determined by subtracting this upward reaction force from the downward load applied to the top ring body 10 through the drive flange 200. Thus, the load applied to the polishing pad 2 from the outer retaining ring 30 can be changed by changing the downward load applied to the top ring shaft 7 from the above-mentioned air cylinder.

As with the previous embodiment, the lateral force (i.e., the frictional force produced between the wafer and the polishing pad 2) applied to the inner retaining ring 20 during polishing of the wafer is transmitted to the outer retaining ring 30 through the stopper 119, and is finally supported by the spherical bearing 210 disposed above the center of the wafer (i.e., disposed on the upper portion of the top ring body 10). The lateral movement of the outer retaining ring 30 is restricted by the spherical bearing 210.

Use of the spherical bearing 210 to support the top ring body 10 offers the following advantages. Even when the top ring body 10 receives a small lateral force, the spherical bearing 210 allows the outer retaining ring 30 to tilt easily around the center of tilting movement. If a diaphragm is used to allow the top ring body to tilt through deformation of the diaphragm, a relatively large force is required to deform the diaphragm, and hence the top ring body cannot tilt easily. This problem greatly affects perpendicularity of the top ring shaft with respect to the polishing surface.

Specifically, if the top ring body is configured to tilt through the deformation of the diaphragm, the top ring body cannot sufficiently absorb a deviation of the perpendicularity of the top ring shaft with respect to the polishing surface, because a large force is required for the tilting movement of the top ring body. The top ring body tilts as the diaphragm is deformed under the frictional force produced between the wafer and the polishing surface during polishing of the wafer. Therefore, a total amount of the tilting movement of the top ring body is determined mainly by: (1) deformation as a result of the absorption of the deviation of the perpendicularity of the top ring shaft; and (2) deformation as a result of the frictional force applied. The factor (1) tends to vary greatly between individual polishing apparatuses. This means that a degree of the tilting movement of the top ring body would vary from apparatus to apparatus. In addition, when the top ring body and the retaining ring follow the polishing surface by the deformation of the diaphragm, they tilt around a center that is not located on the central axis of the wafer. Consequently, it is difficult to exert a concentrated load on the pad region located downstream of the wafer by the tilting movement of the retaining ring.

According to the present embodiment using the spherical bearing 210, even if the perpendicularity of the top ring shaft 7 with respect to the polishing surface 2*a* slightly deviates, the top ring body 10 easily tilts around the center of the tilting movement of the spherical bearing 210 so as to follow the polishing surface 2*a*. Furthermore, the top ring body 10 and the outer retaining ring 30 tilt smoothly under the frictional force that is produced between the wafer and the polishing surface 2*a* when the wafer is polished. In this manner, by positively allowing the outer retaining ring 30 to tilt around the center of the tilting movement which is located on the central axis of the wafer, the outer retaining ring 30 can apply a concentrated load to the region of the polishing pad 2 located downstream of the wafer. Since the top ring body 10 is made of a relatively highly rigid material, such metal or ceramic, the top ring body 10 is less likely to be deformed, and can tilt smoothly by the spherical bearing 210.

Figure 22:
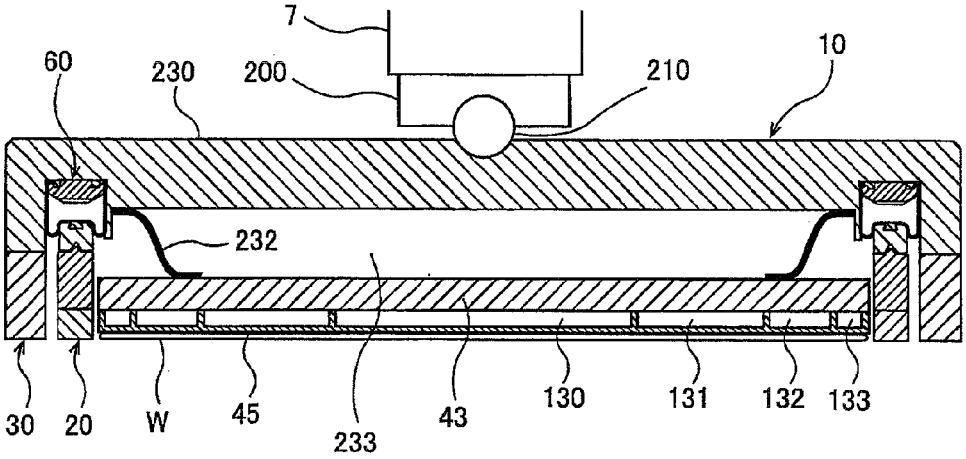
FIG. 22 is a cross-sectional view of a modified example of the top ring shown in FIG. 19.

FIG. 22 is a cross-sectional view of a modification of the top ring shown in FIG. 19. The top ring body 10 shown in FIG. 22 includes: a top ring base 230; and the carrier 43 holding the flexible membrane 45. The spherical bearing 210 is disposed between the top ring base 230 and the drive flange (load transfer member) 200. The top ring base 230 is freely tiltable with respect to the drive flange 200. The outer retaining ring 30 is fixed to the top ring base 230, so that the outer retaining ring 30 is tiltable in unison with the top ring base 230. The top ring base 230 is an element corresponding to the flange 41 and the spacer 42 shown in FIG. 19.

The carrier 43 is separated from the top ring base 230, and is coupled to the top ring base 230 by a flexible membrane 232. With these structures, the carrier 43 is vertically movable relative to the top ring base 230. The carrier 43, the top ring base 230, and the flexible membrane 232 jointly form a pressure chamber 233. When the pressurized fluid is supplied into the pressure chamber 233, the carrier 43 and the flexible membrane 45 are lowered. When negative pressure is developed in the pressure chamber 233, the carrier 43 and the flexible membrane 45 are elevated. Therefore, the pressure chamber 233 serves as a vertically moving mechanism for vertically moving the carrier 43 and the flexible membrane 45.

Figure 23:
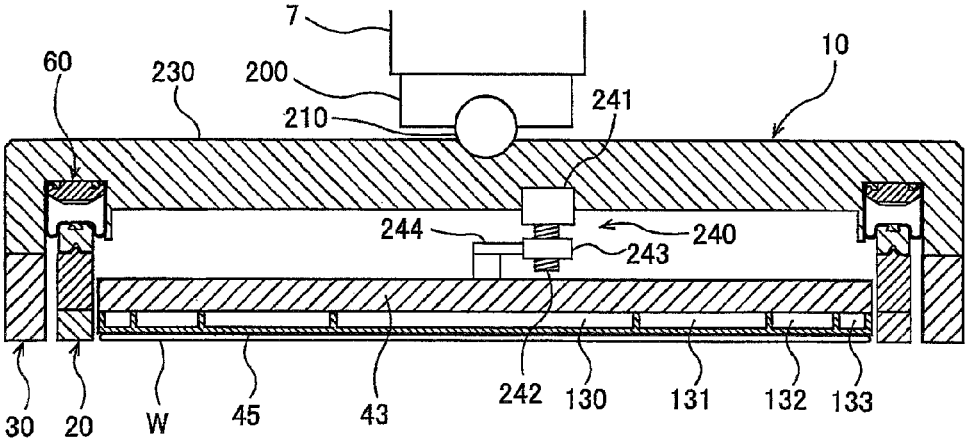
FIG. 23 is a cross-sectional view of another modified example of the top ring shown in FIG. 19.

FIG. 23 is a cross-sectional view of another modification of the top ring shown in FIG. 19. The top ring shown in FIG. 23 does not include the above-described flexible membrane 232. Instead, a vertically moving mechanism 240 is provided for coupling the carrier 43 to the top ring base 230. This vertically moving mechanism 240 includes: a servomotor 241 fixed to the top ring base 230; a ball screw 242 rotatable about its own axis by the servomotor 241; a nut 243 through which the ball screw 242 is threaded; and a frame 244 holding the nut 243. The frame 244 is secured to the carrier 43. When the ball screw 242 is rotated by the servomotor 241, the carrier 43 and the flexible membrane 45 are vertically moved relative to the top ring base 230. Other structural details of the top ring shown in FIG. 23 are identical to those shown in FIG. 22.

According to the present embodiment, the outer retaining ring 30 is fixed to the top ring body 10. Therefore, as the outer retaining ring 30 is worn, the height of the top ring body 10 with respect to the polishing surface 2*a* varies. Such a variation in the height of the top ring body 10 may cause a change in an amount of expansion of the flexible membrane 45 or may make it difficult to raise a polished wafer stably from the polishing surface 2*a*. The pressure chamber 233 or the vertically moving mechanism 240 can adjust the height of the carrier 43, i.e., the vertical position of the carrier 43, in according to the wear of the outer retaining ring 30. Further, the pressure chamber 233 or the vertically moving mechanism 240 can elevate the carrier 43 to raise the wafer from the polishing surface 2*a*.

In the above embodiments, the flexible membrane 45 is disposed substantially over the entire surface of the wafer. However, the flexible membrane 45 may be in contact with at least one portion of the wafer. In addition, while four chambers, i.e., the central chamber 130, the ripple chamber 131, the outer chamber 132, and the edge chamber 133, are provided on the flexible membrane 45 in the above embodiments, the present invention is not limited to this arrangement. For example, less than four or more than four chambers may be provided on the flexible membrane 45. In particular, more than four chambers can control a polishing profile in radially narrower zones of the wafer.

Figure 24:
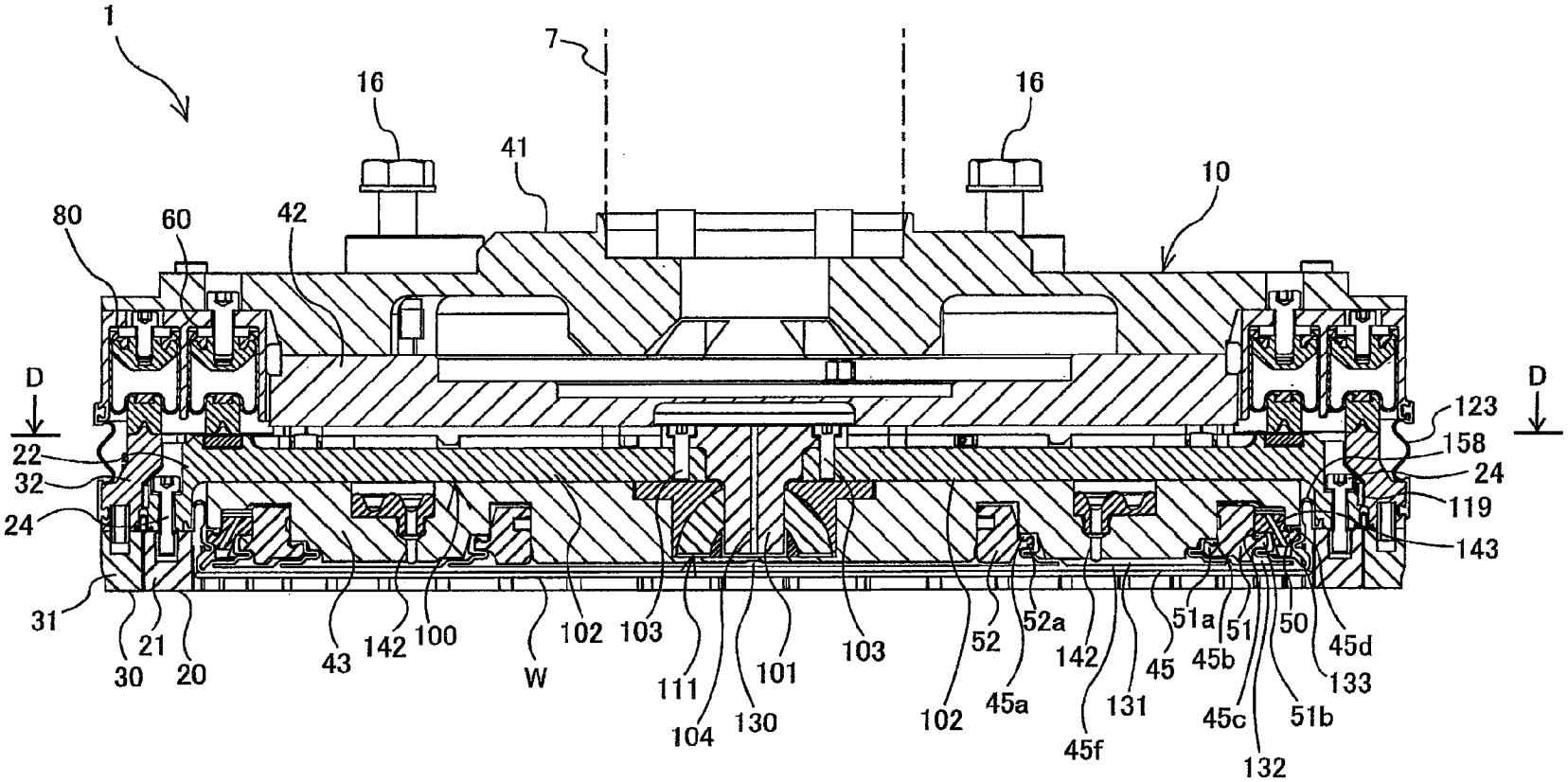
FIG. 24 is a cross-sectional view of still another embodiment of the top ring according to the present invention.
Figure 25:
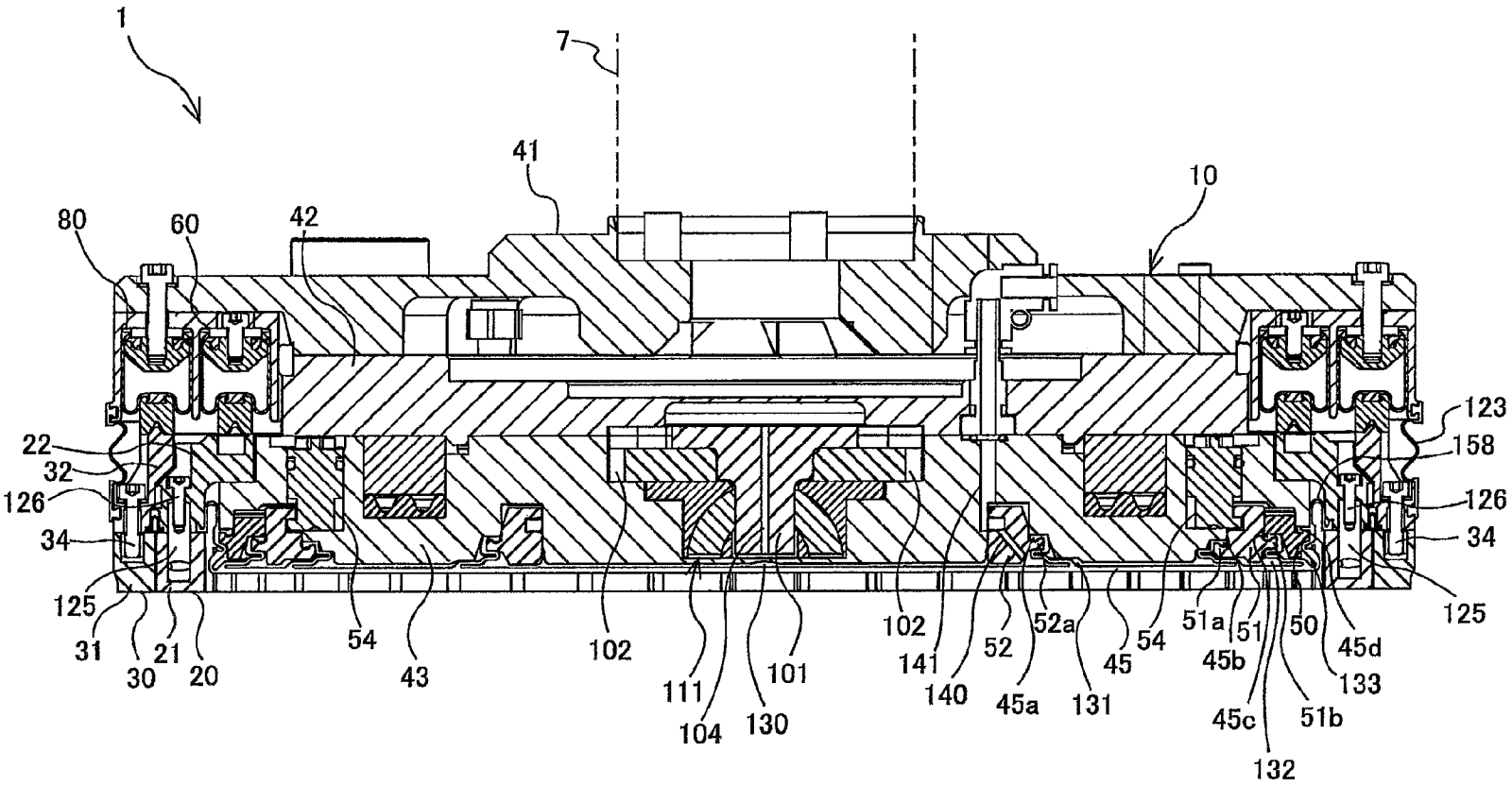
FIG. 25 is another cross-sectional view of the top ring shown in FIG. 24.
Figure 26:
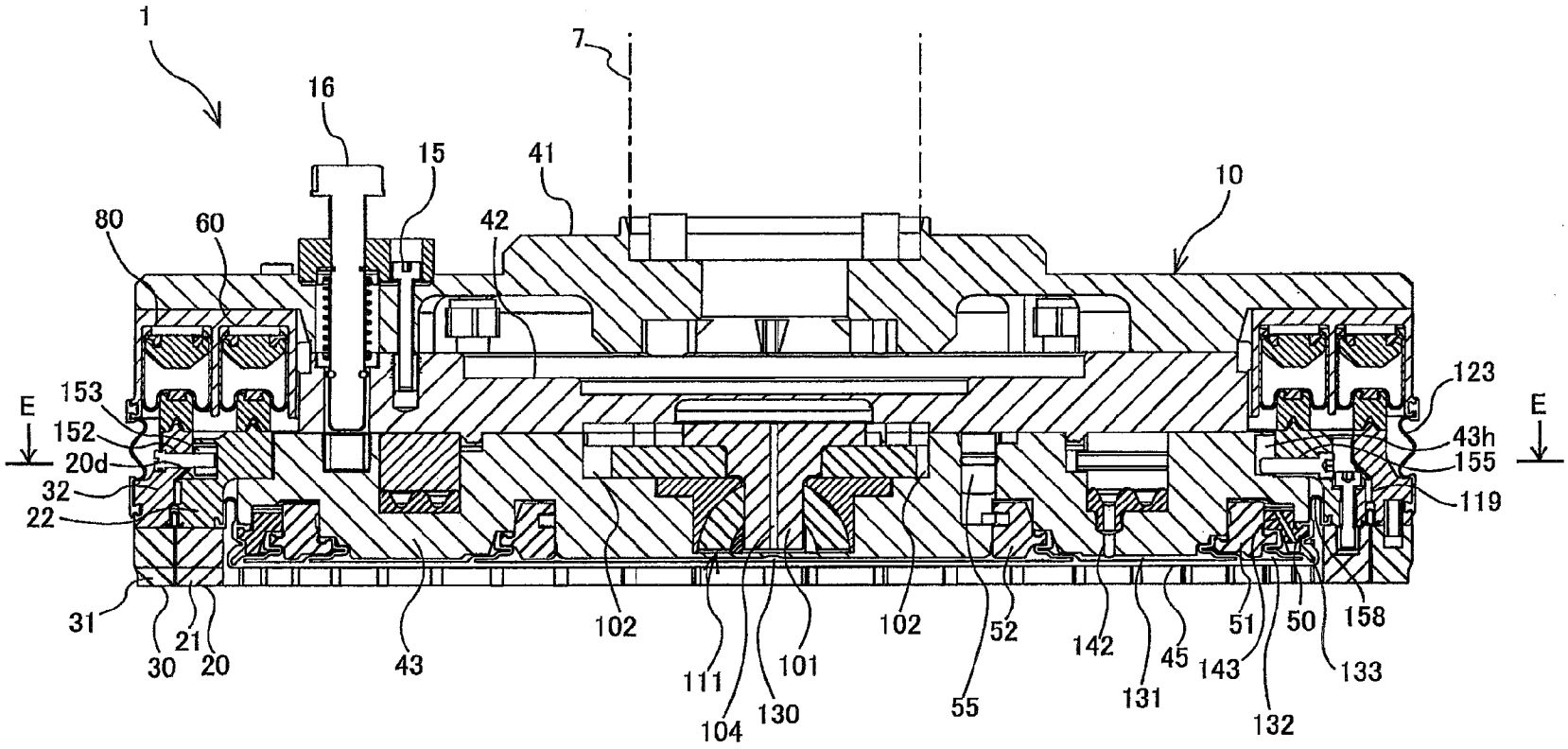
FIG. 26 is still another cross-sectional view of the top ring shown in FIG. 24.
Figure 27:
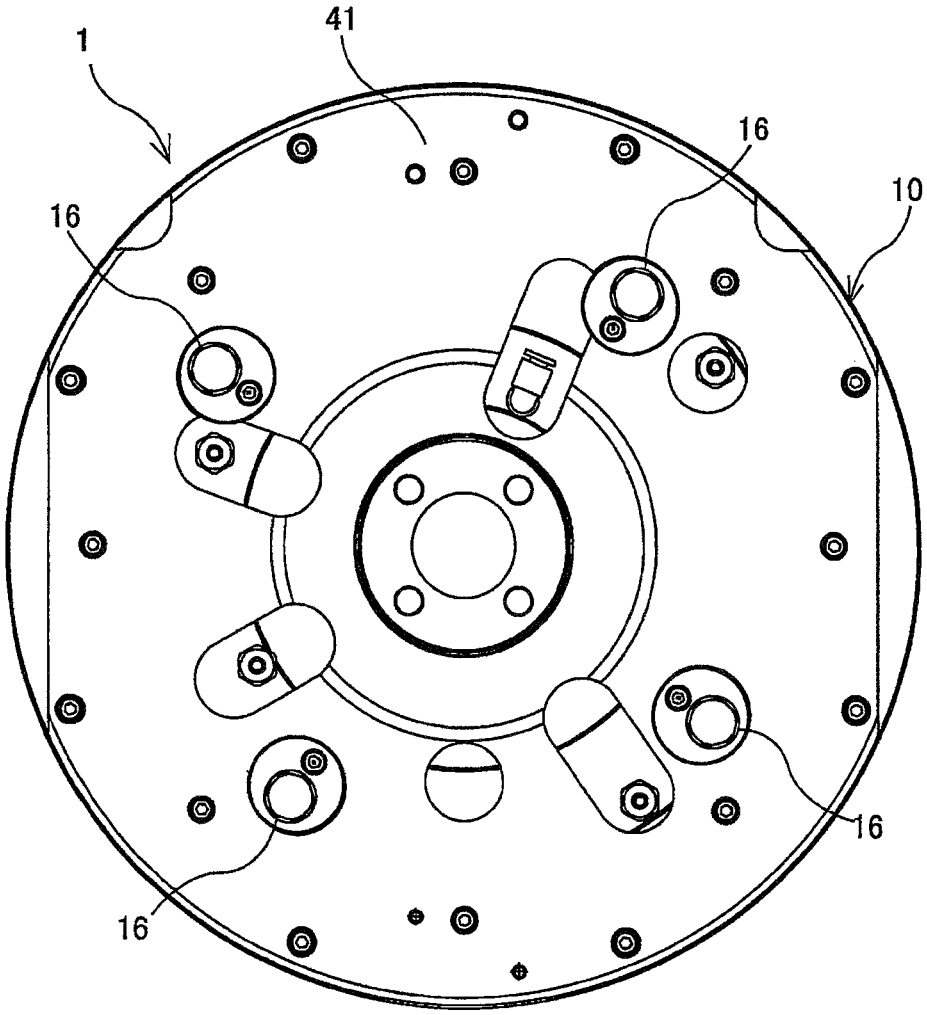
FIG. 27 is a plan view of the top ring shown in FIG. 24.
Figure 28:
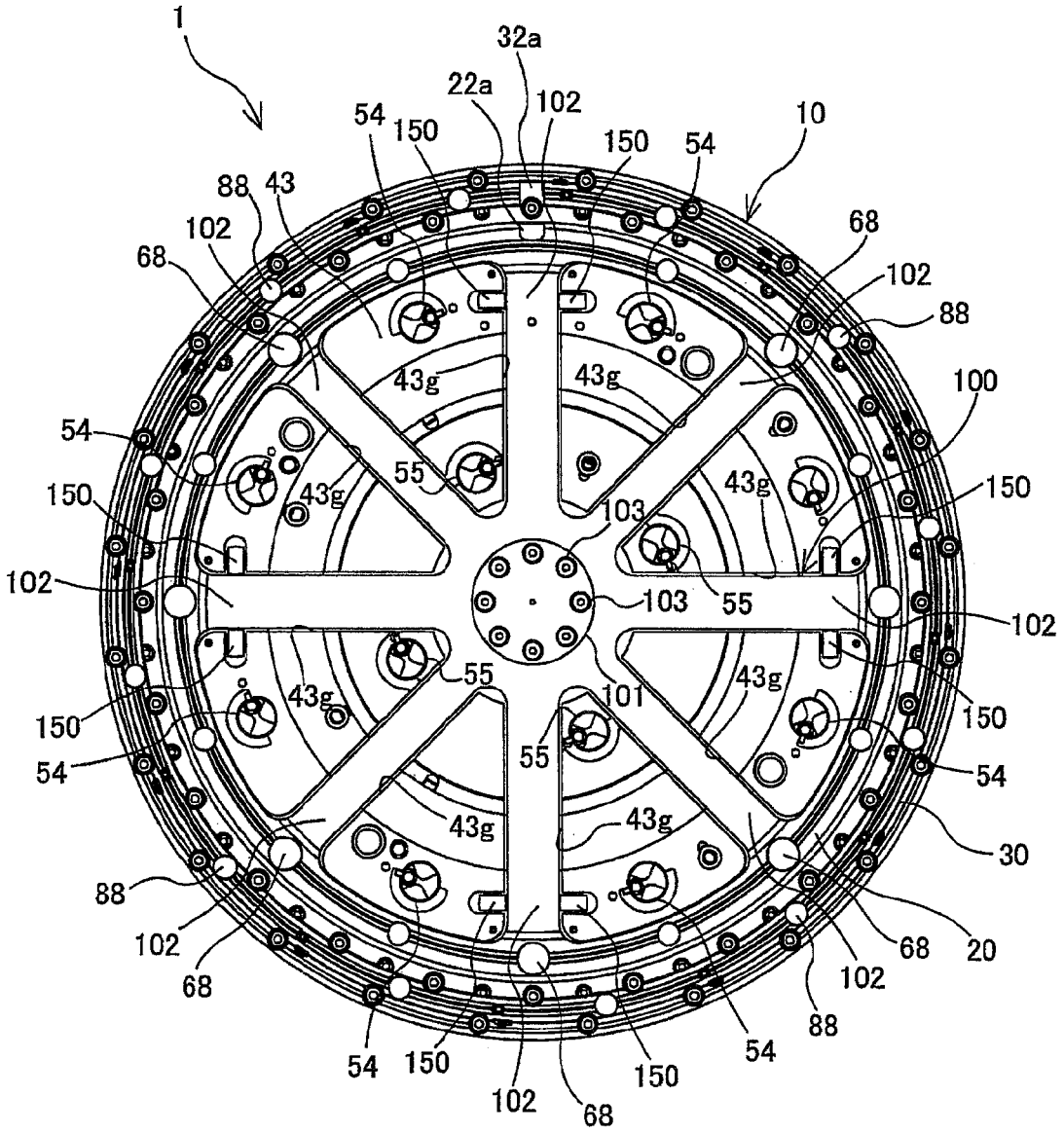
FIG. 28 is a cross-sectional view taken along line D-D in FIG. 24.
Figure 29:
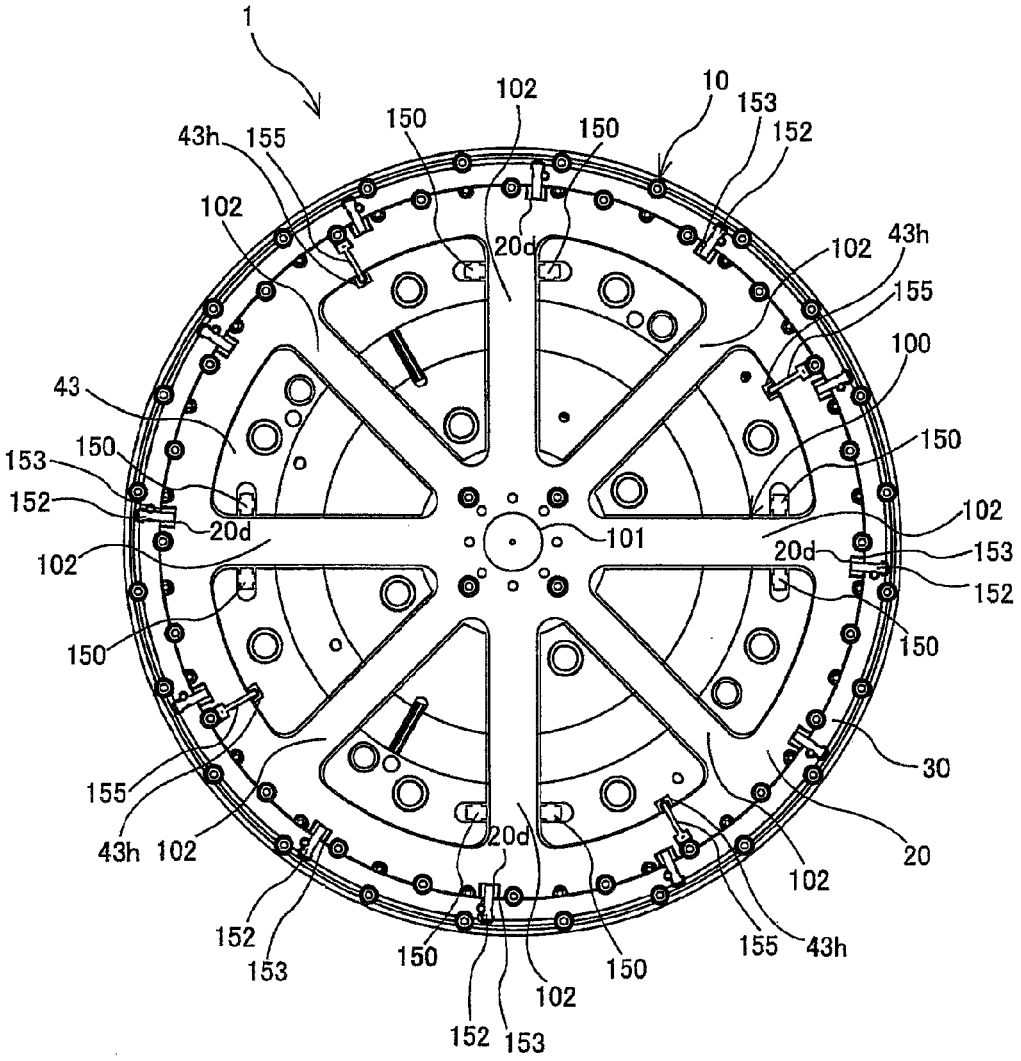
FIG. 29 is a cross-sectional view taken along line E-E in FIG. 26.

Next, the top ring 1 as the substrate holder according to still another embodiment of the present invention will be described below. FIGS. 24 through 26 are cross-sectional views, taken along different radial planes, of the top ring 1. FIG. 27 is a plan view of the top ring 1 shown in FIGS. 24 through 26, FIG. 28 is a cross-sectional view taken along line D-D in FIG. 24, and FIG. 29 is a cross-sectional view taken along line E-E in FIG. 26. Components and operations of the top ring 1 of this embodiment, which will not be described, are identical to components and operations as described previously with reference to FIGS. 2 through 16.

The top ring 1 includes: the top ring body 10 for pressing the wafer W against the polishing surface 2*a*; the inner retaining ring 20 arranged so as to surround the wafer W; and the outer retaining ring 30 arranged so as to surround the inner retaining ring 20. The top ring body 10, the inner retaining ring 20, and the outer retaining ring 30 are rotatable in unison by the rotation of top ring shaft 7. The inner retaining ring 20 is located radially outwardly of the top ring body 10, and the outer retaining ring 30 is located radially outwardly of the inner retaining ring 20. The inner retaining ring 20 is vertically movable independently of the top ring body 10 and the outer retaining ring 30. The outer retaining ring 30 is vertically movable independently of the top ring body 10 and the inner retaining ring 20. The flexible membrane 45, which is brought into contact with a back surface of the wafer W, is attached to the lower surface of the carrier 43.

Figure 30:
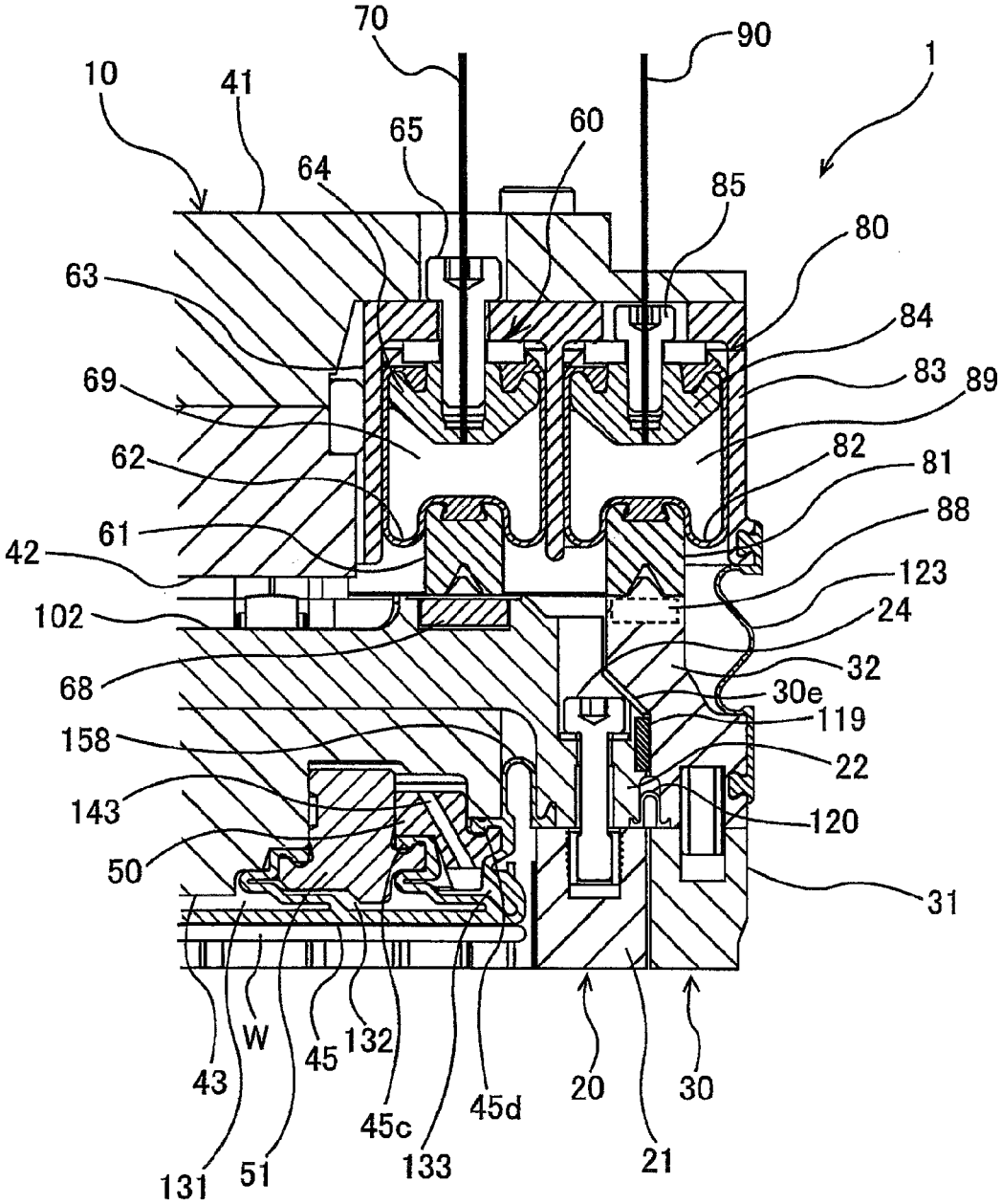
FIG. 30 is an enlarged fragmentary cross-sectional view of the top ring shown in FIG. 24.

FIG. 30 is an enlarged fragmentary cross-sectional view of the inner retaining ring 20 and the outer retaining ring 30 shown in FIG. 24. As shown in FIG. 30, the inner retaining ring 20 is disposed at the periphery of the top ring body 10. The inner retaining ring 20 has: the inner ring member 21 that contacts the polishing surface 2*a* (see FIG. 1) of the polishing pad 2; and the inner drive ring 22 fixed to the upper portion of the inner ring member 21. The inner ring member 21 is secured to the inner drive ring 22 by the bolts 24. The inner ring member 21, which is arranged so as to surround the peripheral edge of the wafer W, retains the wafer W therein so as to prevent the wafer W from being separated from the top ring 1 when the wafer W is being polished.

The inner retaining ring 20 has the upper portion coupled to the inner pressing mechanism 60, which is configured to press the lower surface of the inner retaining ring 20 (i.e., the lower surface of the inner ring member 21) against the polishing surface 2*a* of the polishing pad 2. The inner drive ring 22 is made of metal, such as SUS, or ceramic, and the inner ring member 21 is made of resin, such as PEEK, PPS, or the like.

The inner retaining ring 20 is removably coupled to the inner pressing mechanism 60. More specifically, the inner piston 61 of the inner pressing mechanism 60 is made of a magnetic material, such as metal, and magnets 68 are disposed on the upper portion of the inner drive ring 22. These magnets 68 magnetically attract the inner piston 61, so that the inner retaining ring 20 is magnetically secured to the inner piston 61. The magnetic material of the inner piston 61 may be corrosion resisting magnetic stainless steel, for example. Alternatively, the inner drive ring 22 may be made of a magnetic material, and magnets may be disposed on the inner piston 61.

The outer retaining ring 30 is arranged so as to surround the inner retaining ring 20. The outer retaining ring 30 has: the outer ring member 31 that contacts the polishing surface 2*a* of the polishing pad 2; and the outer drive ring 32 fixed to the upper portion of the outer ring member 31. The outer ring member 31 is secured to the outer drive ring 32 by the bolts 34 (see FIG. 25). The outer ring member 31 is disposed so as to surround the inner ring member 21 of the inner retaining ring 20. The inner ring member 21 and the outer ring member 31 are kept out of contact with each other at all times with the gap formed between the inner ring member 21 and the outer ring member 31.

The outer retaining ring 30 has the upper portion coupled to the outer pressing mechanism 80, which is configured to press the lower surface of the outer retaining ring 30 (i.e., the lower surface of the outer ring member 31) against the polishing surface 2*a* of the polishing pad 2. The outer drive ring 32 is made of metal, such as SUS, or ceramic, and the outer ring member 31 is made of resin, such as PEEK, PPS, or the like.

The outer retaining ring 30 is removably coupled to the outer pressing mechanism 80. More specifically, the outer piston 81 of the outer pressing mechanism 80 is made of a magnetic material, such as metal, and the magnets 88 are disposed on the upper portion of the outer drive ring 32. These magnets 88 magnetically attract the outer piston 81, so that the outer retaining ring 30 is magnetically secured to the outer piston 81. Alternatively, the outer drive ring 32 may be made of a magnetic material, and magnets may be disposed on the outer piston 81.

During polishing of the wafer, the flexible membrane 45 presses the wafer W against the polishing surface 2*a* of the polishing pad 2, while the inner retaining ring 20 and the outer retaining ring 30 directly press the polishing surface 2*a* of the polishing pad 2. The inner retaining ring 20 and the outer retaining ring 30 are configured to be movable independently of each other in the vertical direction relative to the top ring body 10, and are coupled respectively to the inner pressing mechanism 60 and the outer pressing mechanism 80. With these arrangements, the inner pressing mechanism 60 and the outer pressing mechanism 80 can separately press the inner retaining ring 20 and the outer retaining ring 30 against the polishing surface 2*a* of the polishing pad 2.

The top ring 1 shown in FIGS. 24 through 30 is different from the top ring 1 shown in FIGS. 2 through 16 in that, instead of the outer retaining ring 30, the inner retaining ring 20 is coupled to the spherical bearing 111 through the coupling member 100. This spherical bearing 111 is arranged radially inwardly of the inner retaining ring 20. Structures, position, and operations of the spherical bearing 111 are identical to those shown in FIG. 9 and FIGS. 10A through 10C, and their repetitive explanations are omitted.

The coupling member 100 has: the vertically extending shaft portion 101 disposed centrally in the top ring body 10; and the spokes 102 extending radially from the shaft portion 101. The spokes 102 have one ends fixed to the shaft portion 101 by the bolts 103, and have the other ends fixed to the inner drive ring 22 of the inner retaining ring 20. In this embodiment, the spokes 102 are integral with the inner drive ring 22. The inner retaining ring 20 is coupled to the intermediate bearing ring 114 (see FIG. 9) through the coupling member 100.

The shaft portion 101 of the coupling member 100 is vertically movably supported by the spherical bearing 111 located at the center of the top ring body 11. The coupling member 100 and the inner retaining ring 20 secured to the coupling member 100 are thus vertically movable relative to the top ring body 10.

As shown in FIG. 9, the through-hole 114*c* of the intermediate bearing ring 114 has the diameter smaller than those of the through-holes 113*c* and 115*b* of the outer bearing ring 113 and the inner bearing ring 115, so that the shaft portion 101 is movable relative to the intermediate bearing ring 114 only in the vertical direction. Therefore, the inner retaining ring 20, which is coupled to the shaft portion 101, is substantially not allowed to move laterally, i.e., horizontally. That is, the inner retaining ring 20 is fixed in its lateral position (i.e., its horizontal position) by the spherical bearing 111.

As shown in FIGS. 10A through 10C, the inner retaining ring 20, which is coupled to the shaft portion 101, is tiltable in unison with the intermediate bearing ring 114 around the fulcrum O and is vertically movable relative to the intermediate bearing ring 114.

The spherical bearing 111 allows the inner retaining ring 20 to move vertically and tilt, while restricting the lateral movement (i.e., the horizontal movement) of the inner retaining ring 20 so as not to permit the transmission of the lateral force from the inner retaining ring 20 to the outer retaining ring 30. Therefore, the spherical bearing 111 serves as the supporting mechanism capable of supporting the lateral force (i.e., the force in the radially outward direction of the wafer) applied to the inner retaining ring 20 from the wafer due to the friction between the wafer and the polishing pad 2 and capable of restricting the lateral movement of the inner retaining ring 20 (i.e., capable of fixing the horizontal position of the inner retaining ring 20).

The inner retaining ring 20 is tiltable around the fulcrum O and is supported by the spherical bearing 111 such that the inner retaining ring 20 is vertically movable on the axis extending through the fulcrum O. It is preferable that the fulcrum O lie as close to the polishing surface 2*a* (i.e., the contact surface between the polishing pad 2 and the wafer) as possible during polishing of the wafer. In the embodiment shown in FIG. 9, the fulcrum O is located slightly above the polishing surface 2*a* during polishing of the wafer. Specifically, the fulcrum O during polishing of the wafer is located above the polishing surface 2*a* by a distance preferably in a range of −15 mm to 15 mm, more preferably in a range of −5 mm to 5 mm. The distance −15 mm means that the fulcrum O is located below the polishing surface 2*a* by a distance of 15 mm. It is most preferable that the fulcrum O lie on the polishing surface 2*a* of the polishing pad 2 during polishing of the wafer, i.e., the distance between the fulcrum O and the polishing surface 2*a* be zero. This is because, when the fulcrum O exists on the polishing surface 2*a*, the frictional force between the wafer and the polishing surface 2*a* does not act as moment of force of tilting the inner retaining ring 20.

With use of the above-described spherical bearing 111, the moment of force to tilt the inner retaining ring 20 becomes zero or very small. Therefore, the degree of the tilting movement of the inner retaining ring 20 becomes small and therefore the inner retaining ring 20 can apply a desired pressing force to the polishing surface 2*a* uniformly.

During polishing of the wafer, the spherical bearing 111 can allow the inner retaining ring 20 to tilt smoothly. During polishing of the wafer, the lateral force (i.e., the horizontal force) is exerted on the inner retaining ring 20 from the wafer due to the friction between the wafer and the polishing pad 2. This lateral force is supported by the spherical bearing 111 located above the center of the wafer, and the lateral movement of the inner retaining ring 20 is restricted by the spherical bearing 111. Therefore, the lateral force is not transmitted from the inner retaining ring 20 to the outer retaining ring 30, so that the outer retaining ring 30 is less likely to tilt with respect to the polishing surface. Moreover, unlike the inner retaining ring 20, the outer retaining ring 30 does not receive the force from the wafer. Therefore, any part of the outer retaining ring 30 is not deformed, and the outer retaining ring 30 can exert a desired pressing force on the polishing surface 2*a* uniformly.

The frictional force generated by the sliding contact between the outer retaining ring 30 itself and the polishing surface 2*a* is considerably smaller than the frictional force generated between the wafer and the polishing surface 2*a*, because the area of contact between the outer retaining ring 30 and the polishing surface 2*a* is small. This frictional force acting on the outer retaining ring 30 is transmitted to the inner retaining ring 20 through the stopper 119 which is disposed between the outer retaining ring 30 and the inner retaining ring 20, and is finally supported by the spherical bearing 111 that serves as the supporting mechanism for supporting the inner retaining ring 20. The stopper 119, which is of a ring shape, is mounted on the outer circumferential surface of the inner drive ring 22. Alternatively, the stopper 119 may be mounted on the inner circumferential surface of the outer drive ring 32. The stopper 119 should preferably be made of resin material having an excellent slidability. The sliding contact surface of the stopper 119 may have a straight or curved vertical cross-sectional shape.

The inner retaining ring 20 is configured to be tiltable independently of the top ring body 10 and the outer retaining ring 30. Since the spherical bearing 111, which supports the inner retaining ring 20 tiltably and vertically movably, is arranged in the top ring body 10 and housed in the recess 43*a* of the carrier 43, the wear debris produced from the sliding contact surfaces of the spherical bearing 111 is confined in the top ring body 10 and does not fall onto the polishing surface 2*a*.

The outer retaining ring 30 can press the polishing surface 2*a* of the polishing pad 2 uniformly during polishing of the wafer. Providing the outer retaining ring 30 produces good results including the improvement of the controllability of the polishing profile of the wafer edge portion. The edge portion of the wafer is the outermost peripheral region of the wafer with a width of about 3 mm. The polishing profile of the wafer edge portion can be controlled by pressing the polishing pad 2 outside of the inner retaining ring 20 with the outer retaining ring 30 during polishing of the wafer. The gap between the inner retaining ring 20 and the outer retaining ring 30 may be changed in order to control such a polishing-pad rebound effect produced by the outer retaining ring 30. The gap between the inner retaining ring 20 and the outer retaining ring 30 (or more specifically the gap between the lower surface of the inner retaining ring 20 and the lower surface of the outer retaining ring 30) is preferably in the range of 0.1 mm to 3 mm.

The top ring 1 according to the present embodiment is configured to control the pressing forces applied to the wafer by the fluid pressures supplied to the central chamber 130, the ripple chamber 131, the outer chamber 132, and the edge chamber 133 of the flexible membrane 45. Accordingly, during polishing of the wafer, the carrier 43 should be in an upward position away from the polishing pad 2. Since the inner retaining ring 20 and the outer retaining ring 30 are vertically movable independently of the top ring body 10, even when the inner retaining ring 20 and the outer retaining ring 30 are worn, the distance between the wafer and the top ring body 10 during polishing of the wafer can be kept constant. Therefore, a stable polishing profile of the wafer can be ensured.

The more details of the top ring 1 will be described below. As shown in FIG. 28, the coupling member 100 that couples the inner drive ring 22 to the spherical bearing 111 has the eight spokes 102 extending radially outwardly. These spokes 102 are housed respectively in the radially extending eight slots 43*g* that are formed on the upper surface of the carrier 43. Plural pairs of inner ring drive collars 150 and 150 are provided on the carrier 43. Each pair of the inner ring drive collars 150 and 150 are disposed on both sides of each spoke 102. In the example shown in FIG. 28, four pairs of inner ring drive collars 150 and 150 are provided for four of the eight spokes 102.

The top ring body 10 is coupled to the top ring shaft 7, so that the top ring body 10 is rotated by the top ring shaft 7. The rotation of the top ring body 10 is transmitted from the carrier 43 to the spokes 102 through the multiple pairs of the inner ring drive collars 150 and 150 to thereby rotate the inner retaining ring 20 in unison with the top ring body 10. The inner ring drive collars 150 are made of a low-friction material, such as PTFE, PEEK, PPS, or the like. The both side surfaces of each spoke 102, which contact the inner ring drive collars 150, are minor-finish surfaces with reduced surface roughness. Alternatively, the inner ring drive collars 150 may have mirror-finish surfaces, while the side surfaces of each spoke 102 may be covered (e.g., coated) with a low-friction material.

These structures can enable the inner ring drive collars 150 and the spokes 102 to slide more smoothly. Therefore, the inner retaining ring 20 can tilt smoothly, and can apply a desired pressing force to the polishing surface 2*a* uniformly. The torque transmission structure for transmitting the rotation of the top ring body 10 to the inner retaining ring 20 is constituted by the inner ring drive collars 150 and the spokes 102. This torque transmission structure is disposed in the top ring body 10. Therefore, any wear debris that has been produced from the torque transmission structure is confined in the top ring body 10 and does not fall onto the polishing surface 2*a*. Consequently, wafer defects, such as scratches, caused by the wear debris can be greatly reduced.

As shown in FIG. 29, the inner retaining ring 20 has the recesses 20*d* formed on the outer circumferential surface thereof. Outer ring drive pins 152, which are mounted on the outer retaining ring 30, are housed in the recesses 20*d*, respectively. Cylindrical outer ring drive collars 153 are mounted on outer circumferential surfaces of the inner ring drive pins 152, respectively. In FIG. 29, horizontal cross sections of the outer ring drive collars 153 are depicted. The outer ring drive collars 153 are made of a low-friction material, such as PTFE, PEEK, PPS, or the like. Each recess 20*d* has opposed side surfaces extending vertically. When the inner retaining ring 20 rotates, the outer ring drive collar 153 is brought into contact with one of the side surfaces of the recess 20*d*. The rotation of the inner retaining ring 20 is transmitted to the outer retaining ring 30 through the outer ring drive pins 152, so that the outer retaining ring 30 rotates in unison with the inner retaining ring 20. The side surfaces of the recess 20*d*, which contact the outer ring drive collar 153, are mirror-finish surfaces with reduced surface roughness.

These structures can enable the outer ring drive collars 153 and the recesses 20*d* to slide more smoothly. Therefore, the inner retaining ring 20 can tilt smoothly, and can apply a desired pressing force to the polishing surface 2*a* uniformly. Moreover, the outer retaining ring 30 can exert a desired pressing force uniformly on the polishing surface 2*a* without being affected by the tilting movement of the inner retaining ring 20. While the inner retaining ring 20 has the recesses 20*d* and the outer retaining ring 30 has the outer ring drive pins 152 in this embodiment, the inner retaining ring 20 may have outer ring drive pins and the outer retaining ring 30 may have recesses. Rubber cushions may be disposed between the outer ring drive pins 152 and the outer ring drive collars 153.

As shown in FIGS. 26 and 29, the stopper pins 155, which project radially inwardly, are fixed to the inner retaining ring 20. These stopper pins 155 are in loose engagement with the respective vertically extending recesses 43*h* formed on the carrier 43 of the top ring body 10. The recesses 43*h* are arranged at equal intervals on the circumferential surface of the carrier 43. Each stopper pin 155 is vertically movable between the upper end and the lower end of each recess 43*h*. In other words, the vertical movement of the inner retaining ring 20 relative to the top ring body 10 is restricted by the stopper pins 155 and the recesses 43*h*. When the stopper pins 155 are brought into contact with the upper ends of the recesses 43*h*, the inner retaining ring 20 is in the uppermost position relative to the top ring body 10. When the stopper pins 155 are brought into contact with the lower ends of the recesses 43*h*, the inner retaining ring 20 is in the lowermost position relative to the top ring body 10. The stopper pins 155 and the recesses 43*h* can prevent the inner retaining ring 20 from falling off the top ring body 10.

As shown in FIG. 26, each outer ring drive collar 153 is vertically movable between the upper end and the lower end of each recess 20*d* formed on the inner retaining ring 20. In other words, the vertical movement of the outer retaining ring 30 relative to the inner retaining ring 20 is restricted by the outer ring drive collars 153 and the recesses 20*d*. When the outer ring drive collars 153 are brought into contact with the upper ends of the recesses 20*d*, the outer retaining ring 30 is in the uppermost position relative to the inner retaining ring 20. When the outer ring drive collars 153 are brought into contact with the lower ends of the recesses 20*d*, the outer retaining ring 30 is in the lowermost position relative to the inner retaining ring 20. The outer ring drive collars 153 and the recesses 20*d* can prevent the outer retaining ring 30 from falling off the inner retaining ring 20, i.e., falling off the top ring body 10.

As shown in FIG. 30, the barrier seal 120, which is an annular flexible membrane, is disposed between the inner retaining ring 20 and the outer retaining ring 30. This barrier seal 120 extends over the entire circumferences of the inner retaining ring 20 and the outer retaining ring 30 so as to seal the gap between the inner retaining ring 20 and the outer retaining ring 30. More specifically, the barrier seal 120 has its inner edge connected to the lower end of the inner driver ring 22 and has its outer edge connected to the lower end of the outer drive ring 32. The barrier seal 120 has an upwardly bent shape with an inverted U-shaped cross section. The barrier seal 120 is made of flexible material. For example, the barrier seal 120 may be made of a highly strong and durable rubber material, such as ethylene propylene rubber (EPDM), polyurethane rubber, silicone rubber, or the like.

The barrier seal 120 is located above the inner ring member 21 and the outer ring member 31 and below the stopper 119. The inner ring member 21 and the outer ring member 31 are kept out of contact with each other at all times, so that the inner retaining ring 20 and the outer retaining ring 30 do not contact each other below the barrier seal 120. Therefore, no wear debris is produced below the barrier seal 120. The barrier seal 120 can prevent particles produced in the top ring body 10 from falling onto the polishing surface 2*a* while allowing the inner retaining ring 20 and the outer retaining ring 30 to move relative to each other, and can also prevent the polishing liquid, i.e., slurry, from entering the top ring body 10 through the gap between the inner retaining ring 20 and the outer retaining ring 30.

The seal sheet 123, which is shaped so as to connect the top ring body 10 to the outer retaining ring 30, is mounted on the circumferential surface of the top ring 1. This seal sheet 123 is an annular flexible membrane extending over the entire circumferences of the top ring body 10 and the outer retaining ring 30 so as to seal the gap between the top ring body 10 and the outer retaining ring 30. Specifically, the seal sheet 123 has its upper end connected to the lower end of the circumferential surface of the top ring body 10 and has its lower end connected to the outer circumferential surface of the outer retaining ring 30. The seal sheet 123 has a bellows shape so that it can be easily deformed in the vertical direction. As with the barrier seal 120, the seal sheet 123 is made of a highly strong and durable rubber material, such as ethylene propylene rubber (EPDM), polyurethane rubber, silicone rubber, or the like.

The seal sheet 123 can prevent particles produced in the top ring body 10 from falling onto the polishing surface 2*a* while allowing the outer retaining ring 30 to move relative to the top ring body 10 in the vertical direction, and can also prevent the polishing liquid, i.e., the slurry, from entering the top ring body 10 through the gap between the top ring body 10 and the outer retaining ring 30.

It is noted that the present invention is not limited to the above-described embodiments and that various modifications may be applied to other embodiments in accordance with the technical concept of the present invention.

What is claimed is:

1. A substrate holder, comprising:

a top ring body configured to hold a flexible membrane for pressing a substrate against a polishing surface;

an inner retaining ring configured to be vertically movable independently of said top ring body and arranged around said flexible membrane;

an inner pressing mechanism configured to press said inner retaining ring against the polishing surface;

an outer retaining ring arranged radially outwardly of said inner retaining ring and configured to vertically movable independently of said inner retaining ring and said top ring body;

an outer pressing mechanism configured to press said outer retaining ring against the polishing surface; and a supporting mechanism configured to receive a lateral force applied to said inner retaining ring from the substrate during polishing of the substrate, and supporting mechanism being coupled to said outer retaining ring and supporting said outer retaining ring tiltably with respect to said inner retaining ring.

2. The substrate holder according to claim 1, wherein said supporting mechanism comprises a spherical bearing.

3. The substrate holder according to claim 1, wherein said inner pressing mechanism and said outer pressing mechanism are configured to be able to press said inner retaining ring and said outer retaining ring against the polishing surface independently of each other.

4. The substrate holder according to claim 1, wherein a center of tilting movement of said outer retaining ring lies on a central axis of said outer retaining ring.

5. The substrate holder according to claim 1, wherein said outer retaining ring is vertically movably supported by said supporting mechanism.

6. The substrate holder according to claim 1, further comprising a stopper interposed between said inner retaining ring and said outer retaining ring.

7. A substrate holder, comprising:

a top ring body configured to hold a flexible membrane for pressing a substrate against a polishing surface;

an inner retaining ring configured to be vertically movable independently of said top ring body and arranged around said flexible membrane;

an inner pressing mechanism configured to press said inner retaining ring against the polishing surface, said inner pressing mechanism including a rolling diaphragm arranged between said top ring body and said inner retaining ring;

an outer retaining ring arranged radially outwardly of said inner retaining ring and rigidly secured to said top ring body;

a load transfer member configured to transfer a downward load to said top ring body and said outer retaining ring; and a spherical bearing arranged between said top ring body and said load transfer member and configured to allow said top ring body and said outer retaining ring to tilt with respect to said load transfer member, said outer retaining ring being capable of pressing the polishing surface when the downward load is transferred through said load transfer member to said top ring body and said outer retaining ring.

8. The substrate holder according to claim 7, wherein a center of tilting movement of said top ring body lies on a center of a spherical surface of said spherical bearing.

9. The substrate holder according to claim 7, wherein said top ring body includes a carrier holding said flexible membrane, and a vertically moving mechanism configured to vertically move said carrier.

10. The substrate holder according to claim 7, further comprising a barrier seal coupled to both said inner retaining ring and said outer retaining ring.

11. The substrate holder according to claim 10, further comprising a stopper interposed between said inner retaining ring and said outer retaining ring, said stopper being located above said barrier seal.

12. A substrate holder, comprising:

a top ring body configured to hold a flexible membrane for pressing a substrate against a polishing surface;

an inner retaining ring arranged so as to surround the substrate and configured to contact the polishing surface;

an outer retaining ring arranged radially outwardly of said inner retaining ring and configured to contact the polishing surface said outer retaining ring being out of contact with said inner retaining ring to retain a gap between said outer retaining ring and said inner retaining ring;

an inner pressing mechanism having a rolling diaphragm to press said inner retaining ring against the polishing surface;

a barrier seal arranged so as to seal the gap between said inner retaining ring and said outer retaining ring; and a stopper interposed between said inner retaining ring and said outer retaining ring, said stopper being located above said barrier seal and below said rolling diaphragm.

13. The substrate holder according to claim 12, further comprising:

an inner pressing mechanism configured to press said inner retaining ring against the polishing surface, wherein said inner retaining ring is configured to be vertically movable independently of said top ring body.

14. The substrate holder according to claim 12, further comprising:

an outer pressing mechanism configured to press said outer retaining ring against the polishing surface, wherein said outer retaining ring is configured to vertically movable independently of said inner retaining ring and said top ring body.

15. The substrate holder according to claim 12, wherein said inner retaining ring and said outer retaining ring are kept out of contact below said barrier seal.

16. The substrate holder according to claim 12, further comprising:

a supporting mechanism configured to receive a lateral force applied to said inner retaining ring from the substrate during polishing of the substrate and to tiltably support said outer retaining ring.

17. The substrate holder according to claim 16, wherein said supporting mechanism is located in said top ring body.

18. A substrate holder, comprising:

a top ring body configures to hold a flexible membrane for pressing a substrate against a polishing surface;

an inner retaining ring arranged around said flexible membrane and configured to contact the polishing surface;

an outer retaining ring arranged radially outward of said inner retaining ring and configured to contact the polishing surface, said outer retaining ring being out of contact with said inner retaining ring to retain a gap between said outer retaining ring and said inner retaining ring;

a barrier seal arranged so as to seal the gap between said inner retaining ring and said outer retaining ring; and a supporting mechanism configured to receive a lateral force applied to said inner retaining ring from the substrate during polishing of the substrate and to tiltably support said outer retaining ring.

* * * * *